US007628163B2

(12) United States Patent
Kemper et al.

(10) Patent No.: US 7,628,163 B2
(45) Date of Patent: Dec. 8, 2009

(54) APPARATUS FOR HOLDING NURSING BOTTLE COMPONENTS IN A DISHWASHER

(75) Inventors: Bernard J. Kemper, Bonne Terre, MO (US); David E. Hays, Bonne Terre, MO (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 11/841,452

(22) Filed: Aug. 20, 2007

(65) Prior Publication Data

US 2007/0295868 A1 Dec. 27, 2007

Related U.S. Application Data

(63) Continuation-in-part of application No. 11/411,368, filed on Apr. 26, 2006.

(51) Int. Cl.
*B08B 3/02* (2006.01)

(52) U.S. Cl. ..... 134/135; 134/166 R; 134/170

(58) Field of Classification Search ..... 135/135, 135/166 R, 170; 134/135, 166 R, 170
See application file for complete search history.

(56) References Cited

U.S. PATENT DOCUMENTS

| | | | | |
|---|---|---|---|---|
| 2,141,516 A | | 12/1938 | Clements | |
| 2,472,028 A | * | 5/1949 | Son | 422/310 |
| 3,634,937 A | * | 1/1972 | Green | 434/263 |
| 4,193,588 A | * | 3/1980 | Doneaux | 269/47 |
| 4,498,594 A | * | 2/1985 | Elder | 211/41.9 |
| 4,512,489 A | * | 4/1985 | Green et al. | 220/488 |
| 4,544,529 A | * | 10/1985 | Hoeck | 422/303 |
| 4,732,291 A | | 3/1988 | McConnell | |
| 4,748,993 A | * | 6/1988 | Llewellyn | 134/166 R |
| 4,762,688 A | * | 8/1988 | Berry, Jr. | 422/310 |
| 4,830,200 A | * | 5/1989 | Zambano et al. | 211/133.5 |

(Continued)

FOREIGN PATENT DOCUMENTS

FR 2 769 841 * 4/1999

(Continued)

OTHER PUBLICATIONS

Munchkin Deluxe Dishwater Basket, 11 photos (admitted prior art).

(Continued)

*Primary Examiner*—Frankie L Stinson
(74) *Attorney, Agent, or Firm*—Armstrong Teasdale LLP

(57) ABSTRACT

In an apparatus for holding components of a nursing bottle assembly in a dishwasher, a loading member has a first opening sized and configured for receiving a portion of a first component of the bottle assembly therein to seat the first component on the loading member, and a second opening separate from the first opening. The second opening is sized and configured for receiving a portion of a second component of the bottle assembly therein to seat the second component on the loading member. The first and second openings differ in at least one characteristic indicative of the respective first and second components. A retaining member is connected to the loading member for pivoting movement between an opened position to permit loading of the first and second components onto the loading member and a closed position for use of the apparatus in the dishwasher during operation thereof.

10 Claims, 44 Drawing Sheets

U.S. PATENT DOCUMENTS

| | | | | |
|---|---|---|---|---|
| 4,836,392 | A * | 6/1989 | Constantino | 211/133.5 |
| 4,909,401 | A | 3/1990 | McConnell | |
| 5,211,191 | A | 5/1993 | Brown | |
| 5,213,776 | A * | 5/1993 | Maniero et al. | 422/303 |
| 5,518,115 | A * | 5/1996 | Latulippe | 206/370 |
| 5,690,852 | A | 11/1997 | Saito | |
| 5,732,821 | A * | 3/1998 | Stone et al. | 206/370 |
| 5,840,261 | A * | 11/1998 | Monch | 422/300 |
| 6,426,041 | B1 * | 7/2002 | Smith | 422/28 |
| 6,463,940 | B1 * | 10/2002 | Thomas et al. | 134/56 R |
| 6,814,091 | B2 * | 11/2004 | McConnell et al. | 134/135 |
| 6,910,488 | B2 * | 6/2005 | McConnell et al. | 134/135 |
| 6,915,808 | B2 | 7/2005 | McConnell | |
| 7,478,642 | B2 * | 1/2009 | Koch et al. | 134/135 |
| 2003/0205258 | A1 | 11/2003 | McConnell | |
| 2005/0000554 | A1 | 1/2005 | Curran | |
| 2005/0158222 | A1 * | 7/2005 | Bettenhausen et al. | 422/300 |
| 2006/0065666 | A1 * | 3/2006 | Dunn et al. | 220/676 |
| 2006/0266667 | A1 * | 11/2006 | Mendenhall et al. | 206/427 |
| 2007/0125725 | A1 * | 6/2007 | Kemper et al. | 211/41.3 |

FOREIGN PATENT DOCUMENTS

| | | | |
|---|---|---|---|
| JP | 2005-185664 | * | 7/2005 |

OTHER PUBLICATIONS

International Search Report for PCT/US07/67465, dated Aug. 19, 2008, 8 pages.

* cited by examiner

APPARATUS FOR HOLDING NURSING BOTTLE COMPONENTS IN A DISHWASHER

CROSS REFERENCE TO RELATED APPLICATION

This application is a continuation in part of U.S. patent application Ser. No. 11/411,368, filed on Apr. 26, 2006, which is incorporated herein by reference in its entirety.

FIELD OF THE INVENTION

The present invention relates generally to apparatus for holding components in a dishwasher during cleaning, and more particularly to apparatus for holding one or more components of a nursing bottle assembly in a dishwasher during cleaning.

BACKGROUND OF THE INVENTION

Nursing bottle assemblies are commonly used for feeding infants and typically comprise a bottle and various components such as a nipple, a collar, and a cap. For some commercially available bottle assemblies, such as that available from Handi-Craft Company of St. Louis, Mo. under the tradename DR. BROWN'S NATURAL FLOW, additional components are provided. To clean these bottle assemblies, the bottle components are disassembled from the bottle and the bottle and various components are then loaded individually into a standard dishwasher.

In particular, it is commonplace for the bottles to be placed on the upper rack of the dishwasher along with glasses and cups, and to load the bottle components in bulk (and often crammed) into the utensil basket of the dishwasher. However, some manufacturers of nursing bottle assemblies recommend that the components are not placed in the lower rack of the dishwasher such as in the utensil basket. Instead, these manufacturers recommend that the components are placed in the top rack of the dishwasher so that they are positioned away from the dishwasher's heating elements. As a result, the bottle components may be loaded into a dishwasher safe basket designed for holding such components, and the basket placed on the top rack of the dishwasher.

Loading the bottle components into a utensil basket or separate dishwasher basket in this manner can result in a less than desired cleaning of the bottle components. In particular, some bottle components, upon loading or upon movement in the basket during cleaning, end up being surrounded or otherwise shielded by the other bottle components in the basket to the point that the shielded components are not cleaned as well. It is also possible that some of the bottle components may become nested within other components in the basket. Nesting occurs when one component is receiving into or partially received into another often larger or like-shaped component. For example, a nipple of the bottle can become nested within a cap or another nipple. When this occurs, an effective cleaning of both components is compromised.

There is a need, therefore, for a dishwasher safe apparatus for holding bottle components separate from each other and against movement in or on the apparatus during cleaning in a dishwasher.

SUMMARY OF THE INVENTION

In one aspect, apparatus is for holding components of a nursing bottle assembly in a dishwasher. The nursing bottle assembly comprises a bottle, at least a first component adapted for assembly with the bottle and at least a second component different from the first component and adapted for assembly with the bottle. The apparatus generally comprises a loading member having a first opening sized and configured for receiving a portion of the first component therein to seat the first component on the loading member, and a second opening separate from the first opening and being sized and configured for receiving a portion of the second component therein to seat the second component on the loading member. The first and second openings differ in at least one characteristic indicative of the respective first and second components to facilitate identification of the first opening as being the proper location on the loading member for placement of the first component and of the second opening as being the proper location on the loading member for placement of the second component. The retaining member is connected to the loading member for pivoting movement between an opened position to permit loading of the first and second components onto the loading member and a closed position for use of the apparatus in the dishwasher during operation thereof. In the closed position, the first and second components are generally inhibited against movement relative to the loading member and the retaining member during operation of the dishwasher.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 1:
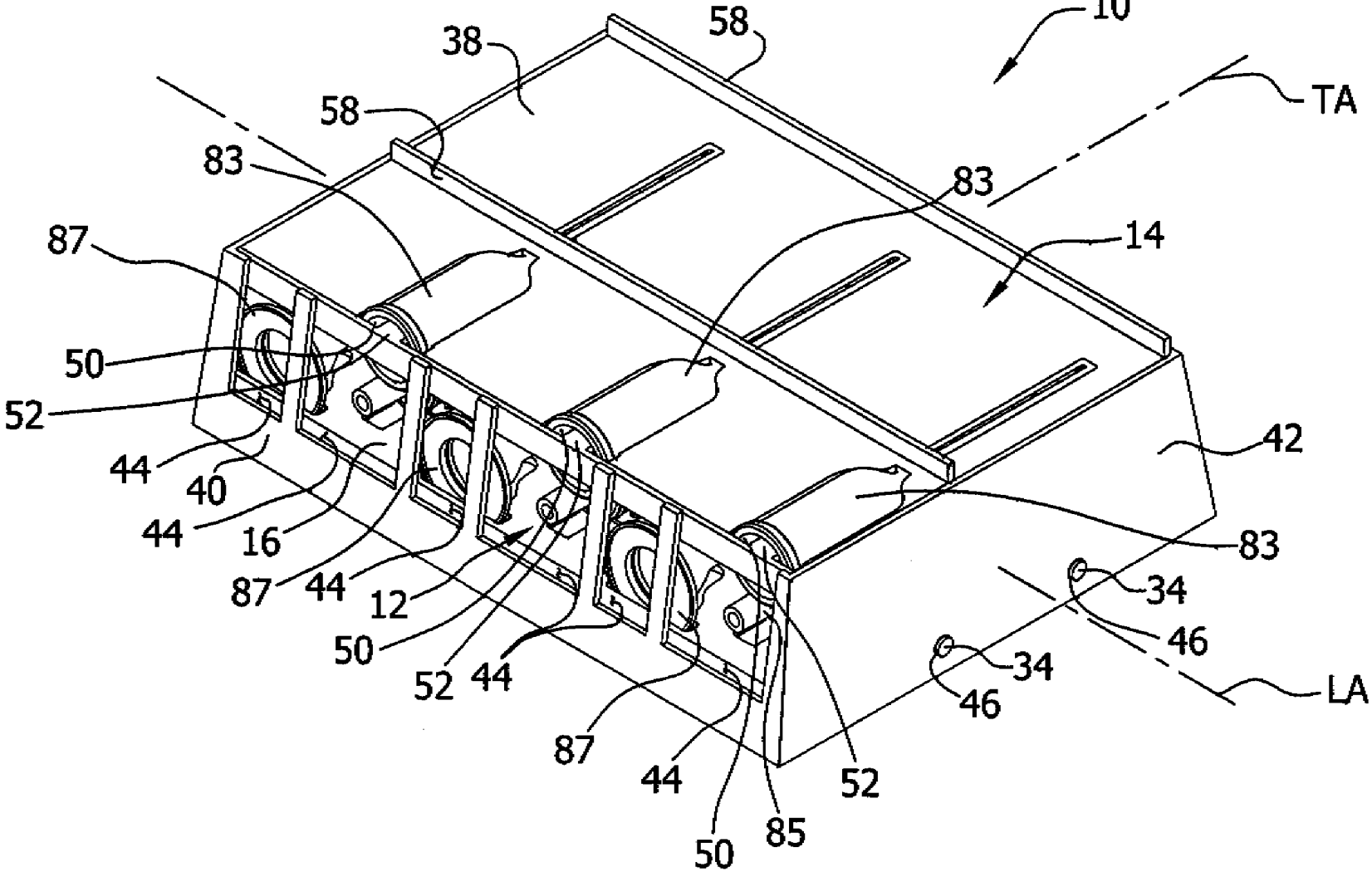
FIG. 1 is a perspective view of one embodiment of apparatus of the present invention for holding one or more components of a nursing bottle assembly.

With reference now to the drawings and in particular to FIG. 1, one embodiment of apparatus of the present invention for holding one or more components of one or more nursing bottle assemblies is indicated generally at 10. As used herein, the term "nursing bottle assembly" refers generally to a bottle and its associated components such as nipple, collar, cap and the like that are assembled with the bottle for storage and/or use. Accordingly, the term "bottle component" as used herein refers to a component of the nursing bottle assembly other than the bottle itself.

Figure 2:
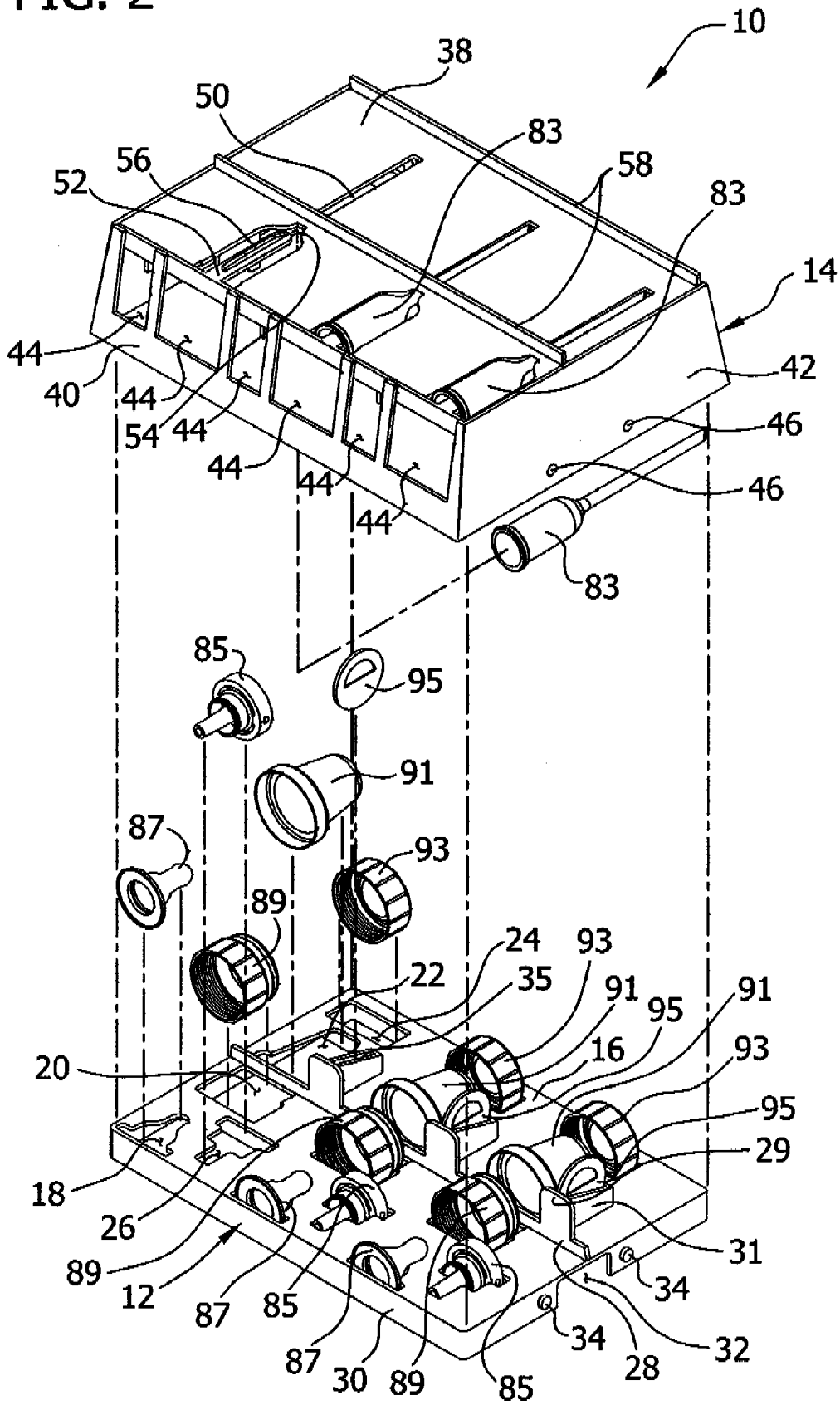
FIG. 2 is an exploded perspective view of the apparatus of FIG. 1 with various components of one nursing bottle assembly exploded from a loading member of the apparatus while the components of two other nursing bottle assemblies are shown arranged on the loading member.
Figure 11:
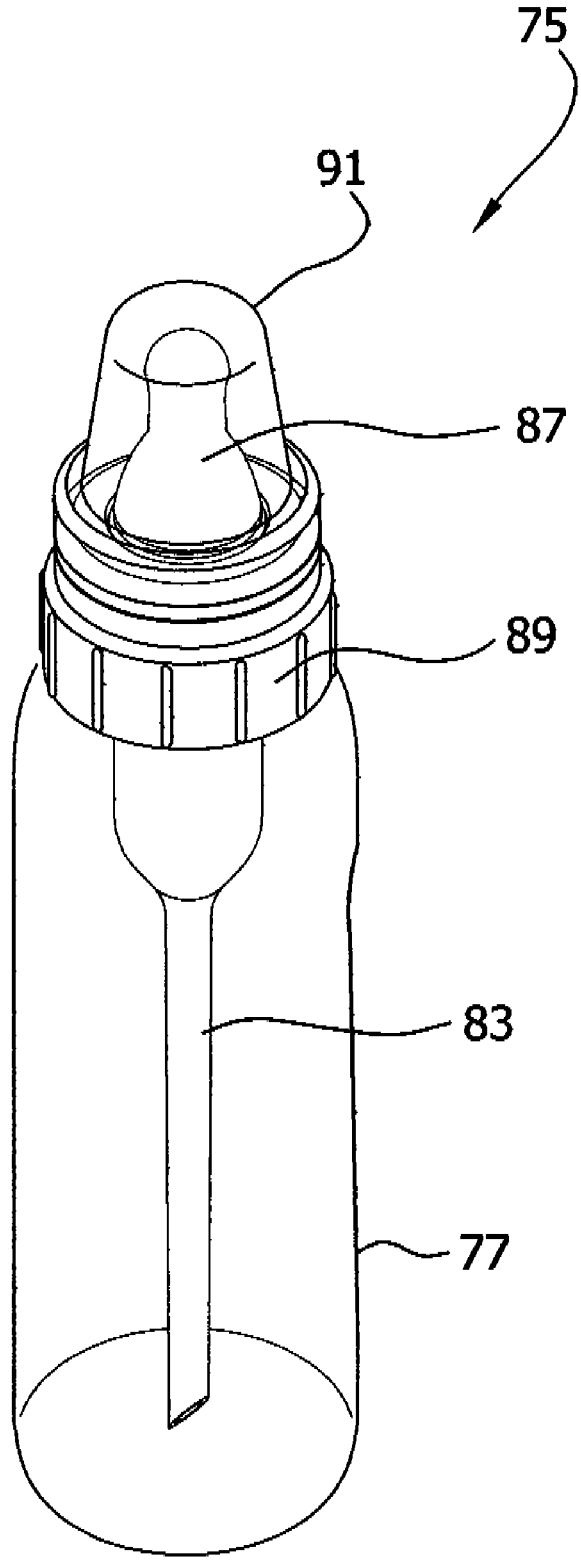
FIG. 11 is a perspective view of a nursing bottle assembly in an assembled condition.
Figure 12:
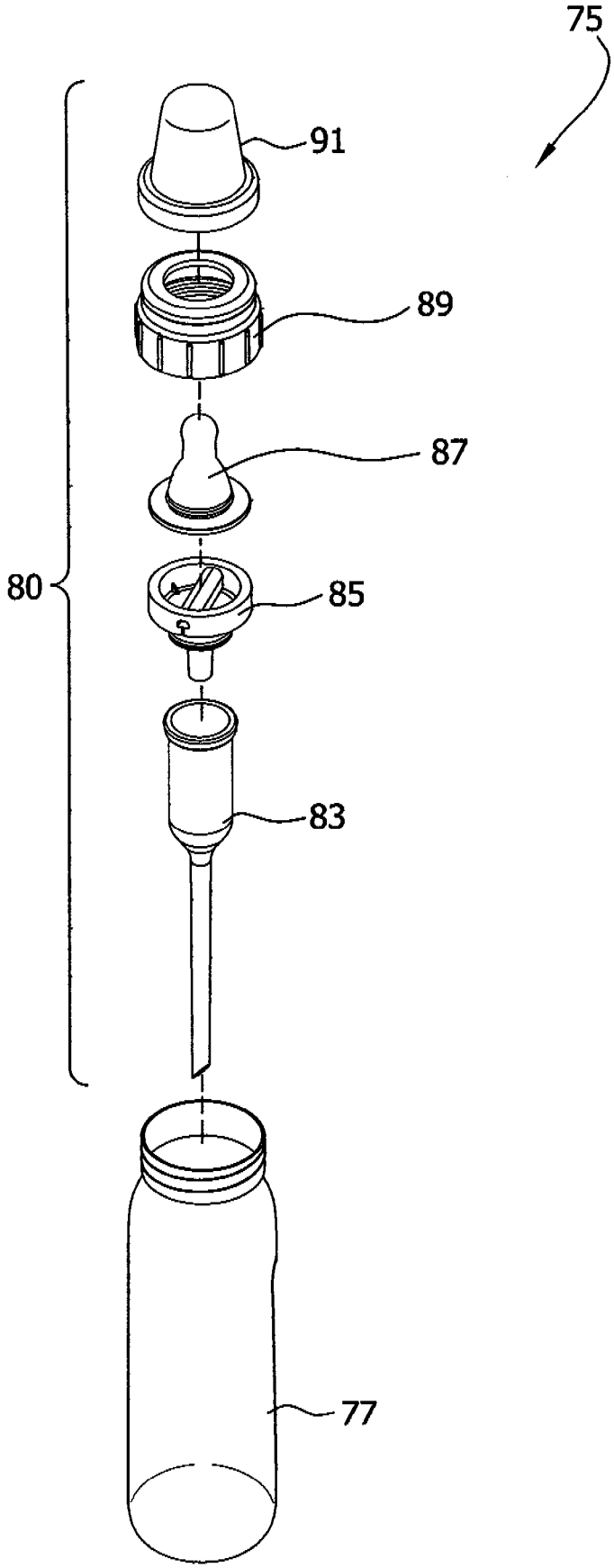
FIG. 12 is an exploded perspective view of the nursing bottle of FIG. 11.
Figure 13:
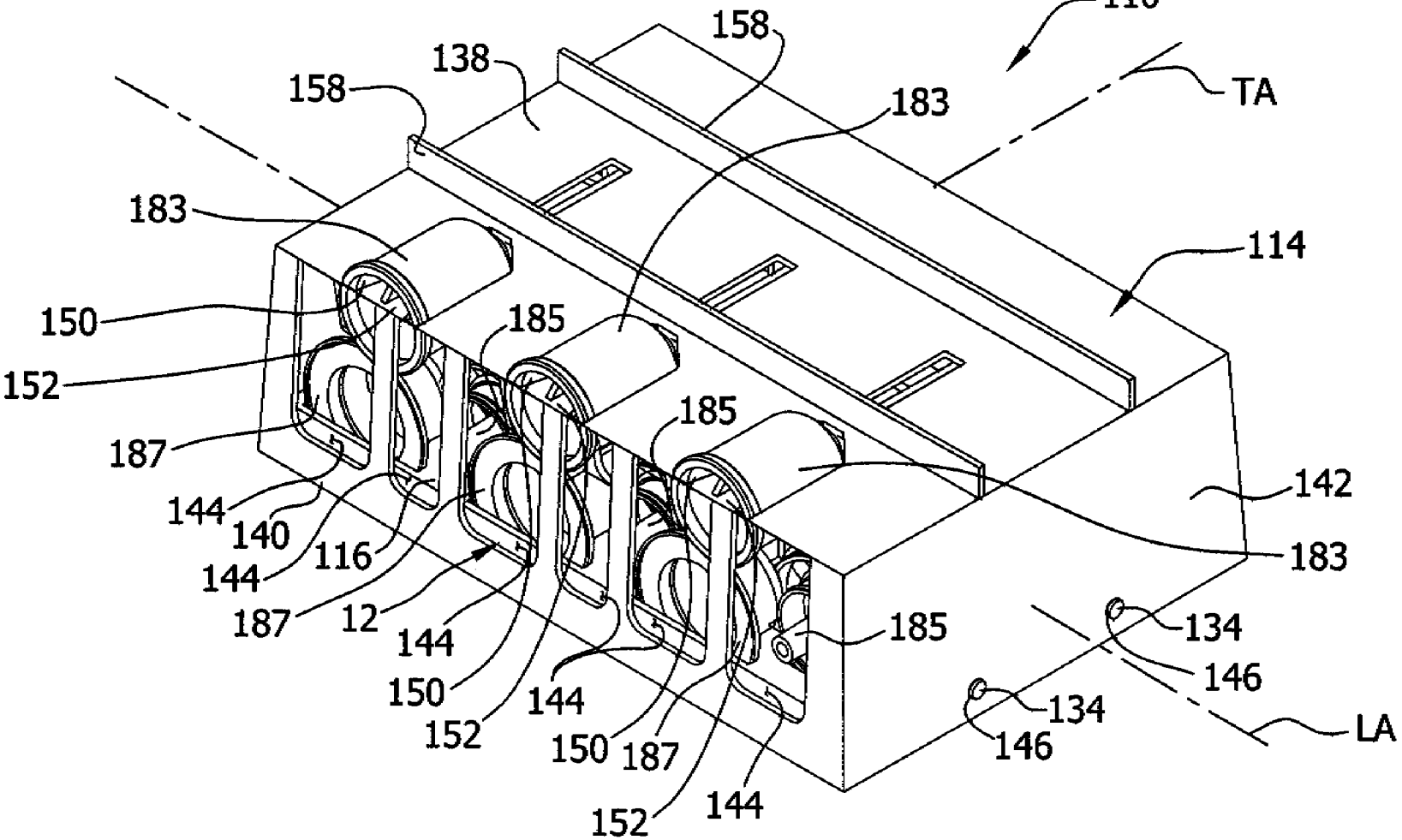
FIG. 13 is a perspective view of a second embodiment of apparatus for holding one or more components of a nursing bottle assembly.
Figure 14:
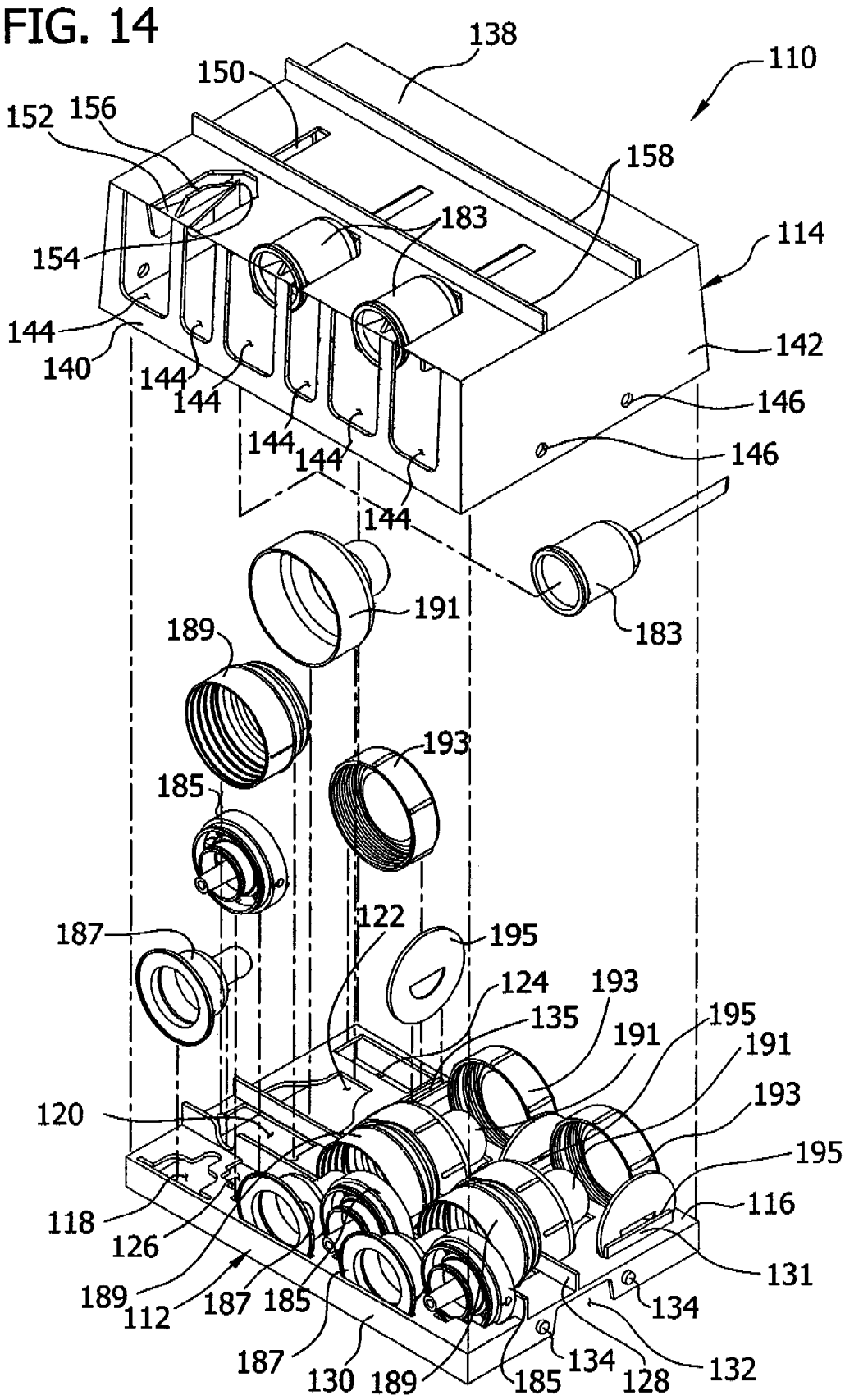
FIG. 14 is an exploded perspective view of the apparatus of FIG. 13 with various components of one nursing bottle assembly exploded from a loading member of the apparatus while the components of two other nursing bottle assemblies are arranged on the loading member.
Figure 15:
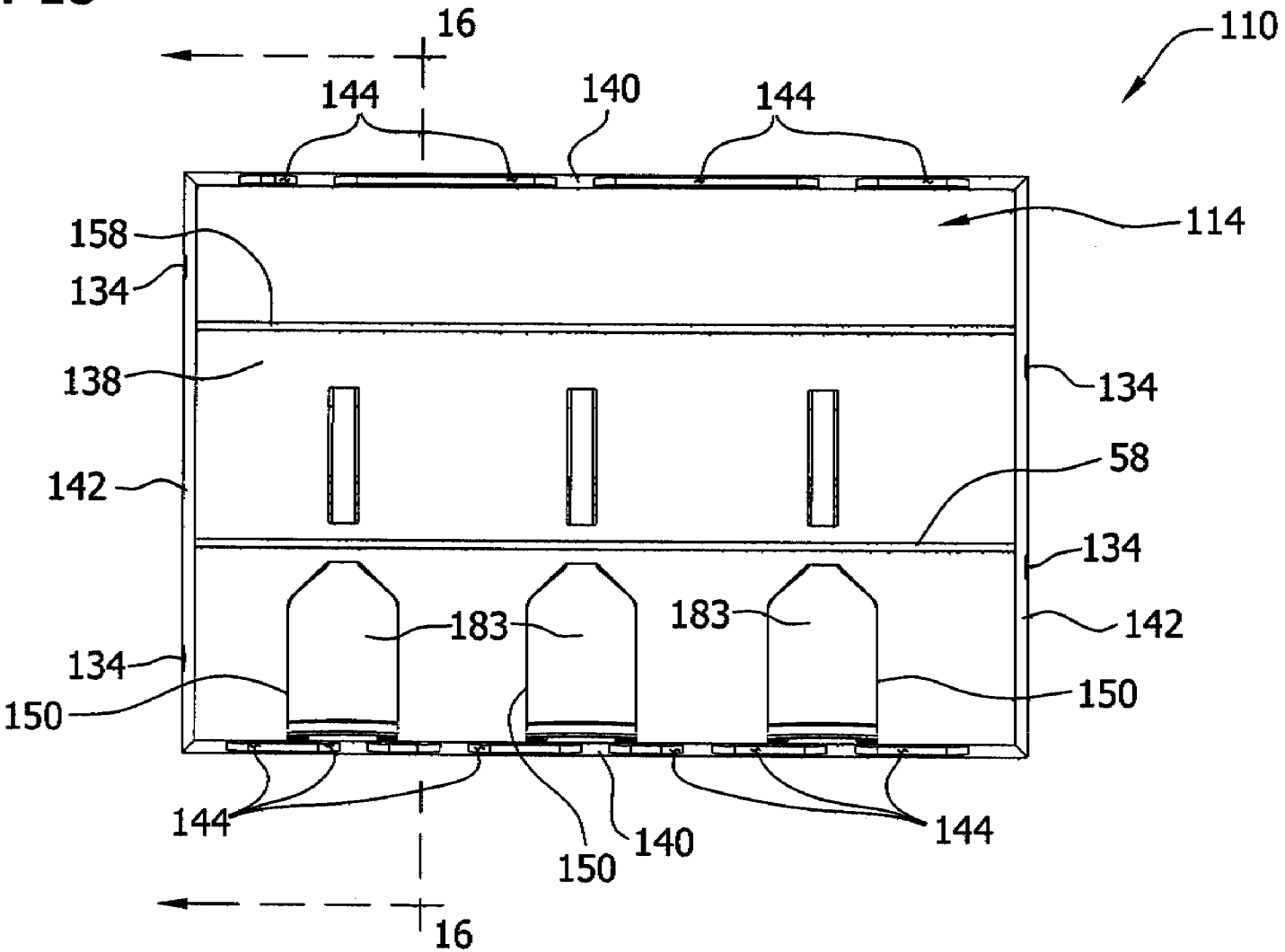
FIG. 15 is a top view of the apparatus of FIG. 13.
Figure 16:
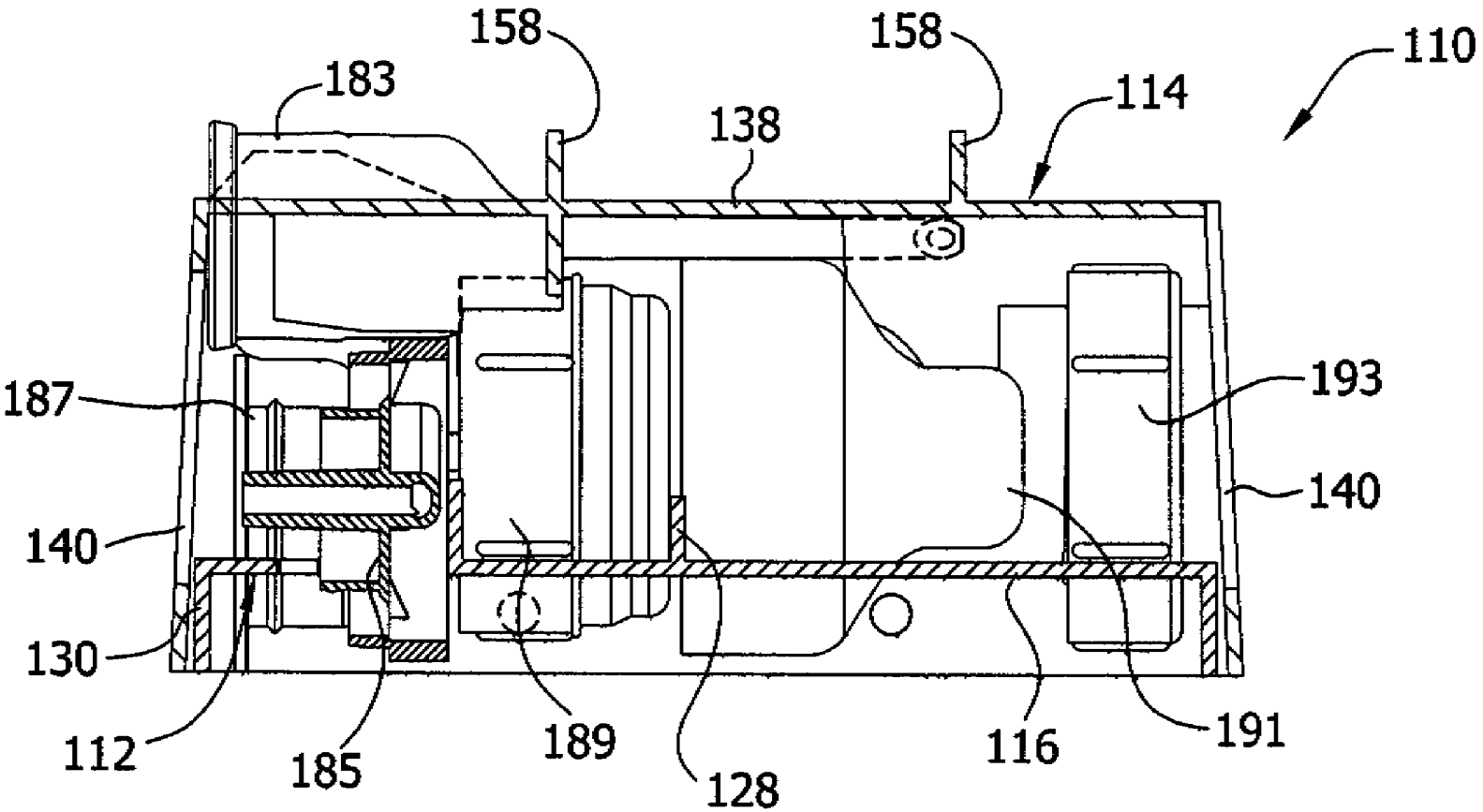
FIG. 16 is a cross-section taken in the plane of line 16-16 of FIG. 15.
Figure 17:
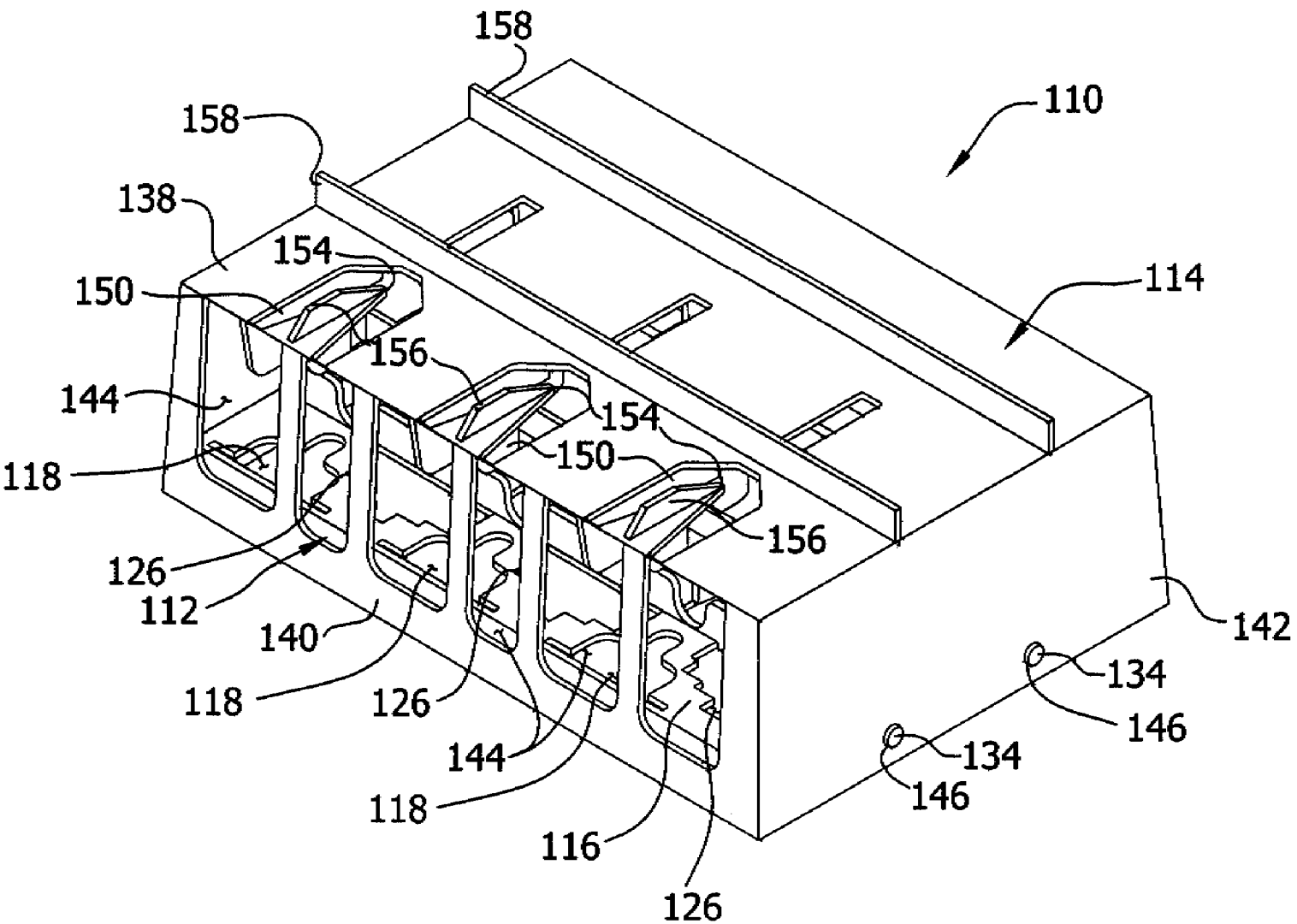
FIG. 17 is a perspective view of the apparatus of FIG. 13 with the various components of the nursing bottle assemblies removed from the apparatus.
Figure 18:
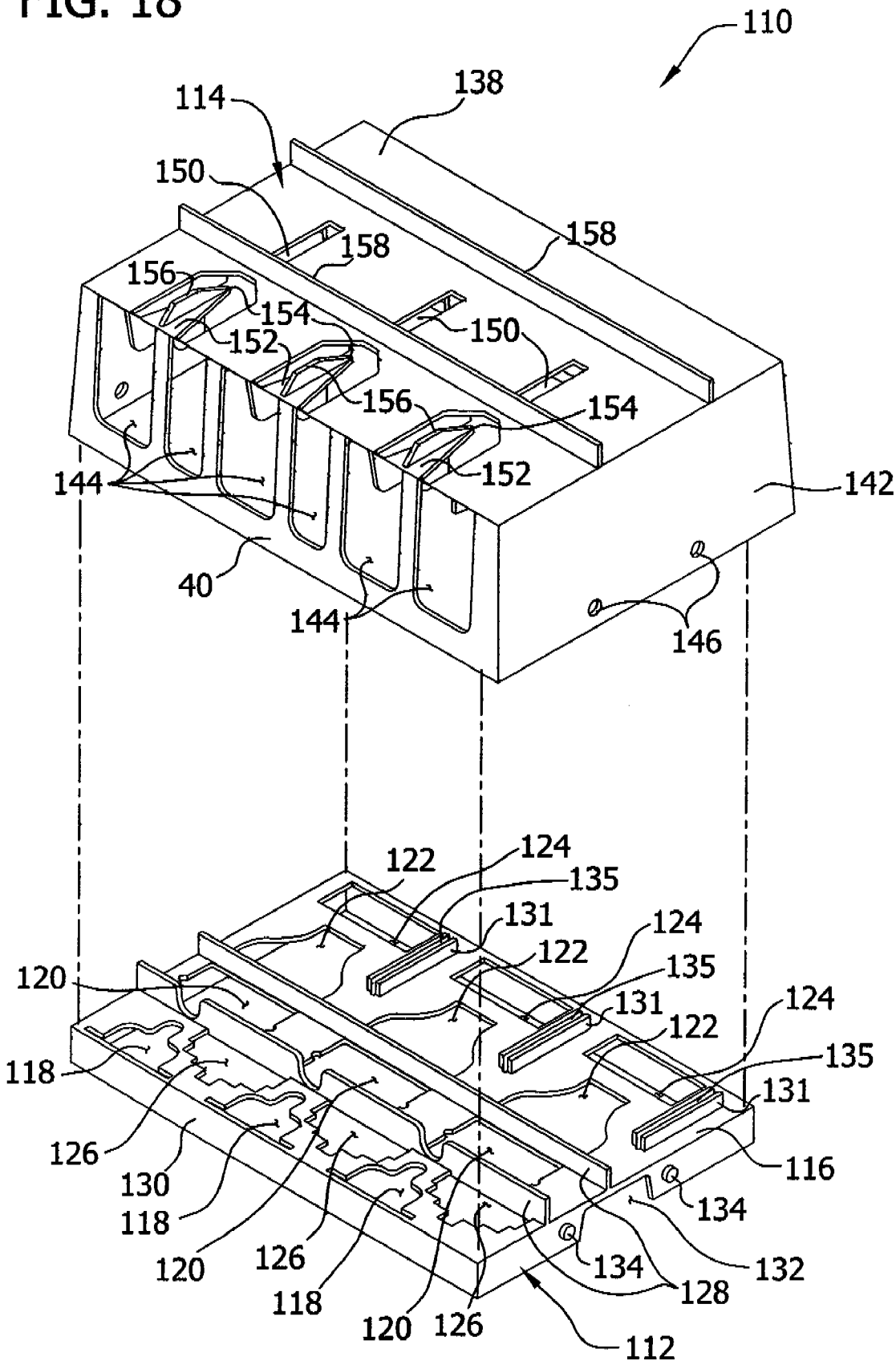
FIG. 18 is an exploded perspective view thereof.
Figure 19:
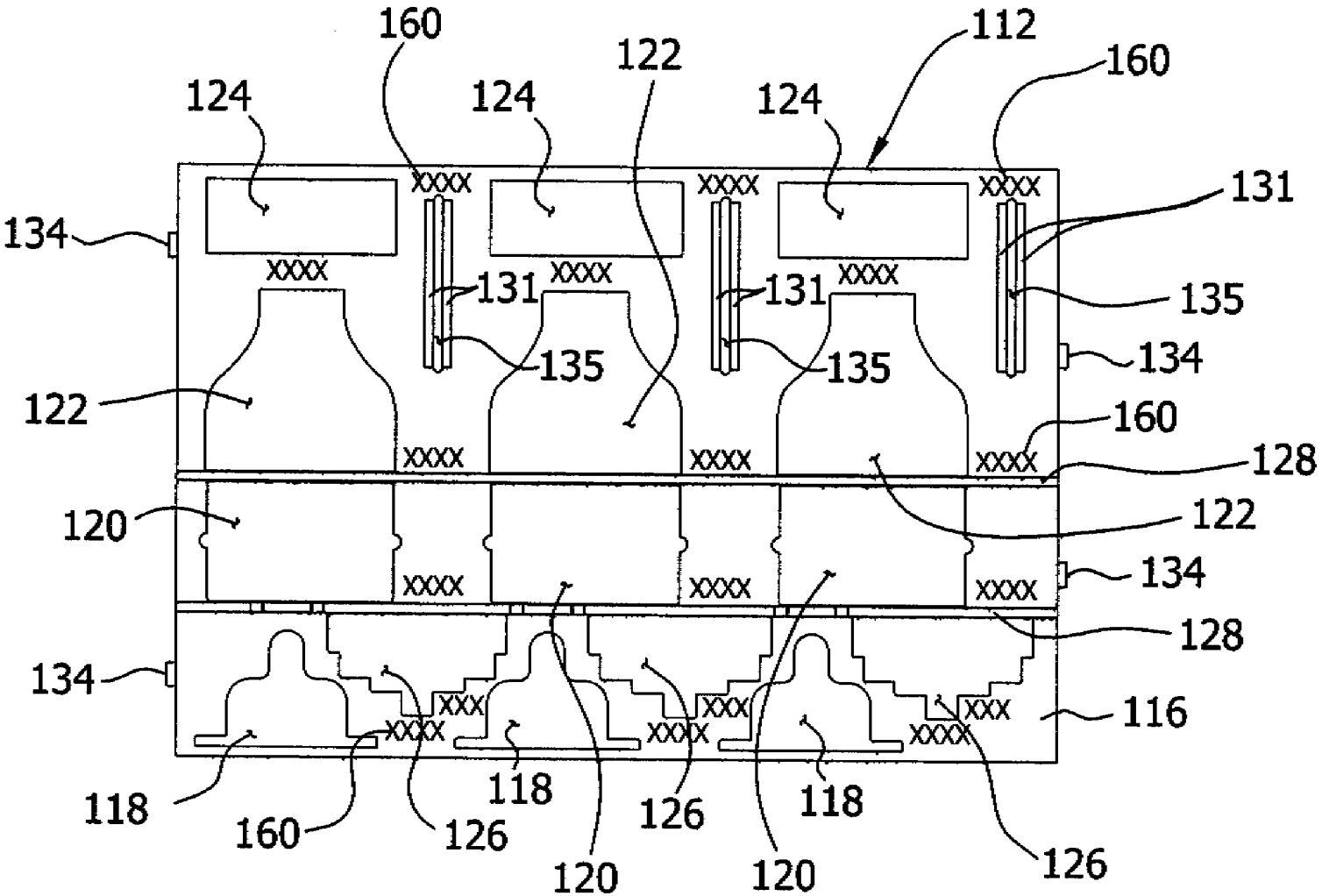
FIG. 19 is a top view of the loading member of the apparatus.
Figure 20:
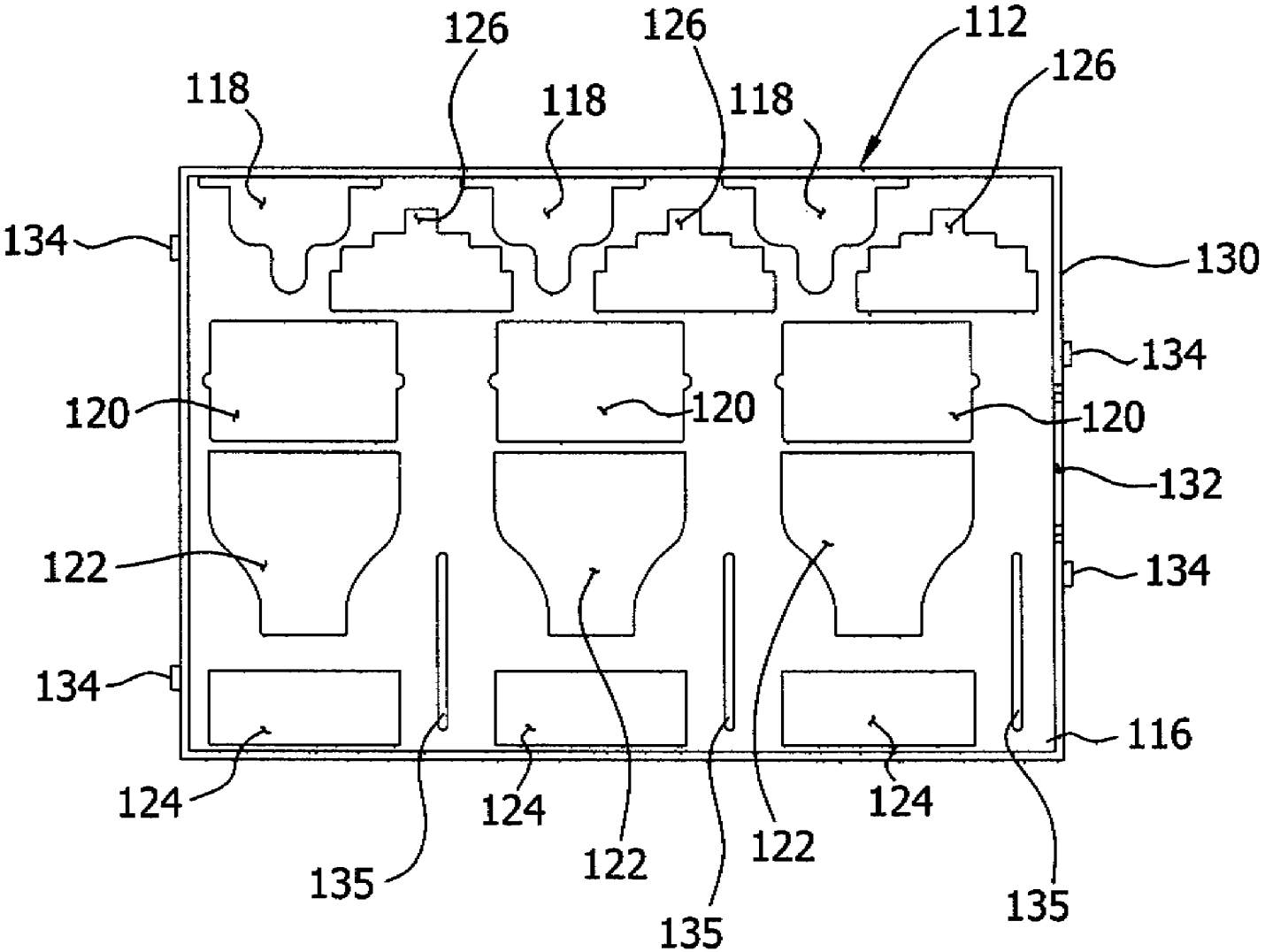
FIG. 20 is a bottom view of the loading member.
Figure 21:
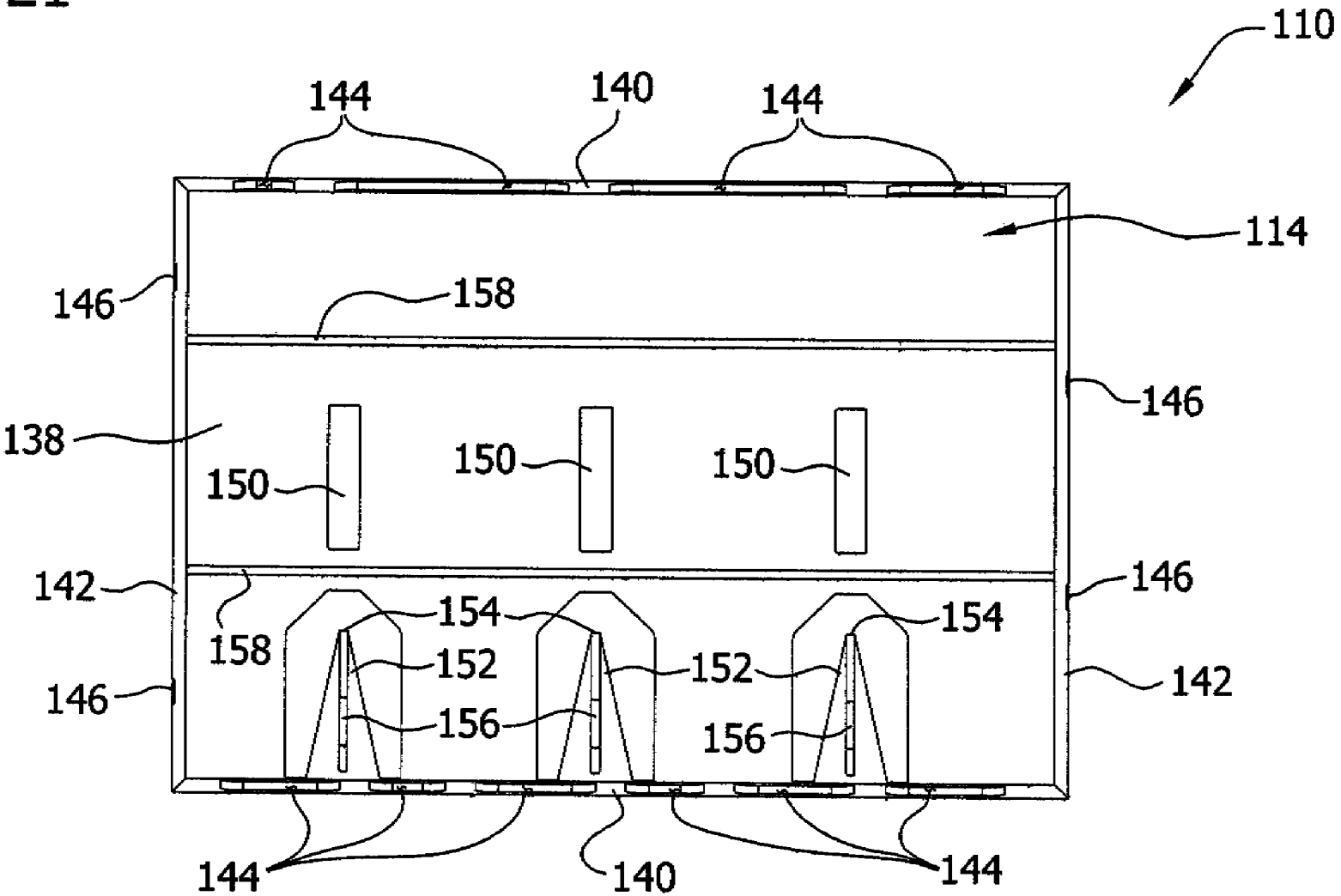
FIG. 21 is a top view of a retaining member of the apparatus.
Figure 22:
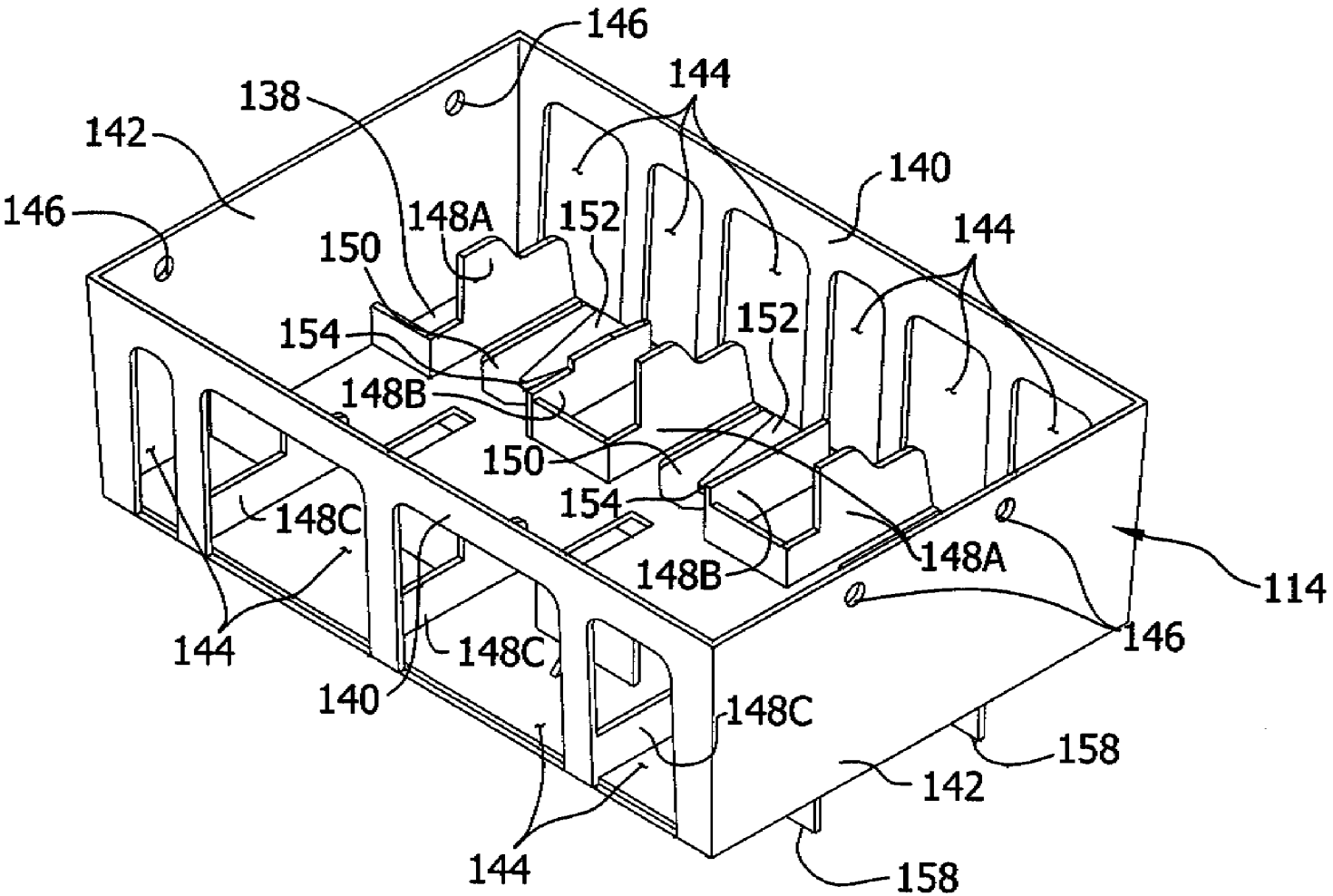
FIG. 22 is a perspective view of the retaining member as illustrated from the bottom of the assembly.

As one example, with reference to FIGS. 11 and 12, the apparatus of the illustrated embodiment is suitably constructed to accommodate the bottle components of a nursing bottle assembly 75 that is commercially available from Handi-Craft Company of St. Louis, Mo. under the tradename DR. BROWN'S NATURAL FLOW. This bottle assembly 75 is particularly configured to vent the interior of the bottle during use and, in addition to a bottle 77, includes bottle components 80 such as a cap 91, collar 89, nipple 87, vent insert 85 and elongate tube 83 that are all subject to cleaning. Additional bottle components that may be used with the bottle assembly 75 are illustrated in FIG. 2 and include a closure travel cap 93, which is used in place of the nipple 87, collar 89, vent insert 85, elongate tube 83, and cap 91 to seal the contents of the bottle during travel or storage, or a disk 95, which can be inserted between nipple 87 and vent insert 85 for sealing the contents of the bottle during travel or storage. It is understood, however, that the apparatus 10 may be configured to accommodate one or more bottle components of other nursing bottle assemblies without departing from the scope of this invention.

More suitably, the apparatus 10 is configured to accommodate all of the bottle components of multiple nursing bottle assemblies. For example, the apparatus 10 illustrated in FIG. 1 is configured to accommodate all of the bottle components 80 of three of the nursing bottle assemblies 75 illustrated in FIGS. 11 and 12. It is understood, however, that the apparatus 10 may be configured to receive the bottle components of one, two or more than three nursing bottle assemblies and remain within the scope of this invention.

With particular reference to FIGS. 1-4, the illustrated apparatus 10 comprises a loading member, generally indicated at 12, on which the bottle components 80 to be cleaned are initially loaded, and a retaining member, indicated generally at 14 adapted for being held in assembly with the loading member during cleaning and configured to hold the bottle components 80 separate from each other and generally stationary during cleaning in the dishwasher. The apparatus 10 is suitably sized and shaped for placement in an upper rack of the dishwasher.

As illustrated in FIGS. 2 and 6-8, the loading member 12 comprises a generally rectangular panel 16 having a skirt 30 depending therefrom and extending about its periphery. The skirt 30 may be formed integrally with the panel 16, such as by being molded therewith, or the skirt may be formed separate from the panel and adhered, welded, bonded or otherwise suitably secured to the panel. The panel 16 of the loading member has an upper, or loading surface onto which the bottle components 80 of the nursing bottle assemblies 75 are arranged to properly load the bottle components into the apparatus 10.

In particular, multiple openings 18, 20, 22, 24, 26 are formed in the panel 16 for positive seating of the various bottle components 80 on the loading surface defined by the panel. One set of openings 18 (broadly, first openings) is sized and configured for receiving a portion of the one bottle components 80, such as the nipple 87. Another set of openings 20 (broadly, second openings) is sized and configured for receiving a portion of a different one of the bottle components 80, such as the collar 89. The other sets of openings 22, 24, 26 are each sized and configured for receiving a portion of the cap 91, closure 93 and vent insert 85, respectively.

In one embodiment, the openings 18, 20, 22, 24 and 26 each differ in at least one characteristic that is indicative of the particular bottle component 80 that is to be seated in the respective opening. That is, each of the openings 18, 20, 22, 24, 26 is thus associated with a respective bottle component such that the person loading the apparatus 10 can readily identify in which opening a particular bottle component 80 is to be placed. For example, in the illustrated embodiment (FIG. 6), the openings 18, 20, 22, 24, 26 have different shapes, with each of the openings being configured to have a shape that corresponds generally to the profile of the respective bottle component 80 that is to be seated in the opening. For example, the openings 18 of the illustrated embodiment are each shaped to correspond generally to the profile of the nipple 87 while the openings 20 are each shaped to correspond generally to the profile of the collar 89. It is understood, however, that the openings 18, 20, 22, 24, 26 are each sized smaller than the actual profile of the respective bottle component 80 so that the bottle component properly seats on the panel 16 partially within the opening without falling entirely through the opening.

It is understood that the openings 18, 20, 22, 24, 26 may be shaped other than to correspond generally to the profiles of the respective bottle components 80 and still differ in at least one characteristic that can be used by the person loading the apparatus 10 to identify the proper opening in which a particular bottle component is to be placed. For example, the openings 18, 20, 22, 24, 26 may each differ in shape and/or size, with each of the different shapes and/or sizes being associated with a different one of the bottle components 80.

Figure 7:
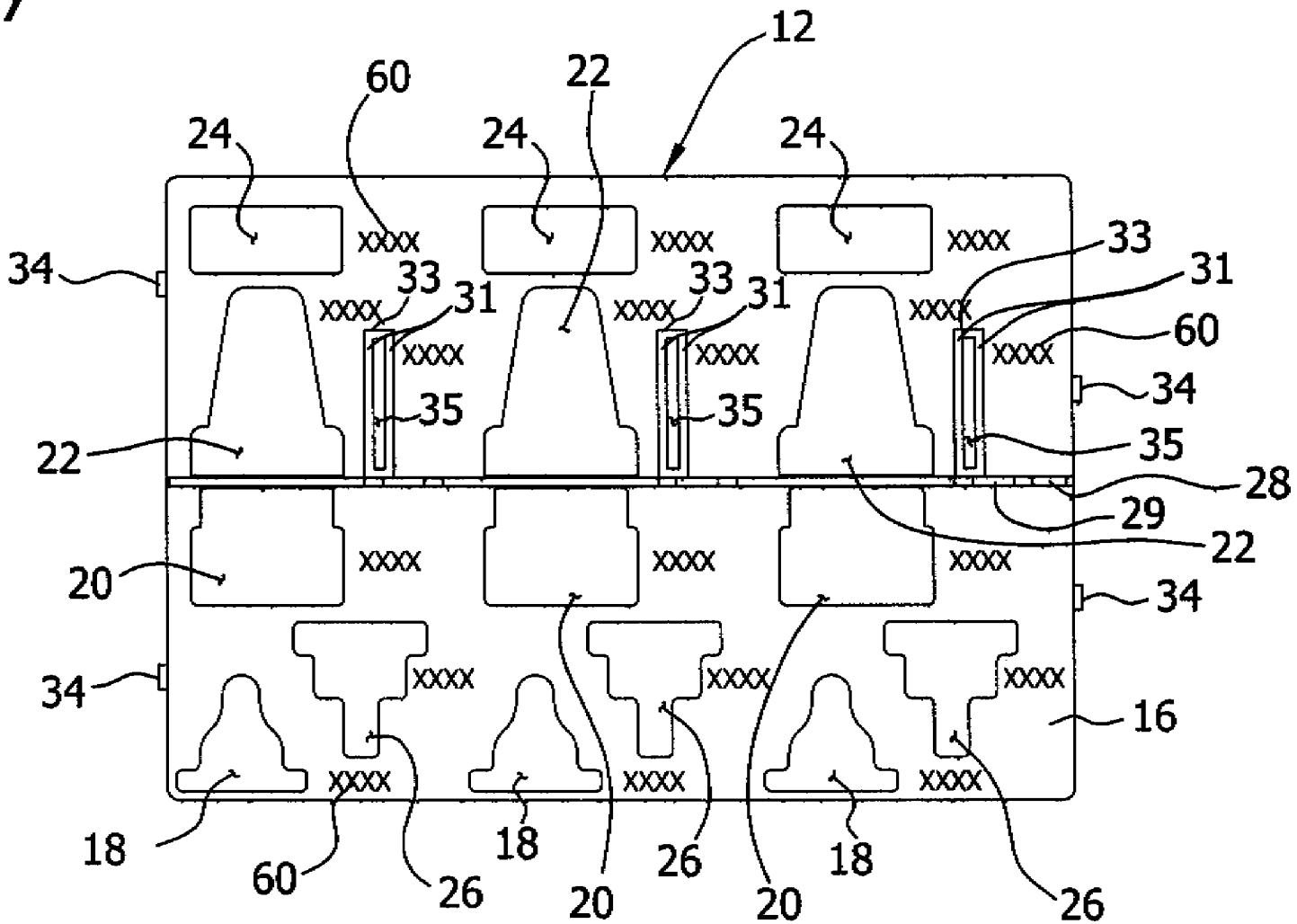
FIG. 7 is a top view of the loading member of the apparatus.

With reference to FIG. 7, in other examples indicia (indicated as 60 in FIG. 7) such as color, graphics and/or alphanumerics may be applied to the panel 16 to indicate to location on the loading surface at which each of the bottle components 80 is to be placed. In one such embodiment, each of the openings 18, 20, 22, 24 and 26 may be outlined by a different color that is associated with the particular bottle component 80 to be placed in the opening. In another such embodiment, a graphic representation or image of the bottle component 80 to be placed in a particular one of the openings 18, 20, 22, 24, 26 may appear on the panel 16 adjacent to the respective opening. In still another such embodiment, the name of the bottle component 80, or a number associated with the bottle component 80 to be placed in a particular one of the openings 18, 20, 22, 24, 26 may appear on the panel adjacent to the respective opening. In still yet another embodiment (not shown), an outline of each component may be disposed around the respective openings to more closely resemble the full size and/or shape of each component.

Figure 6:
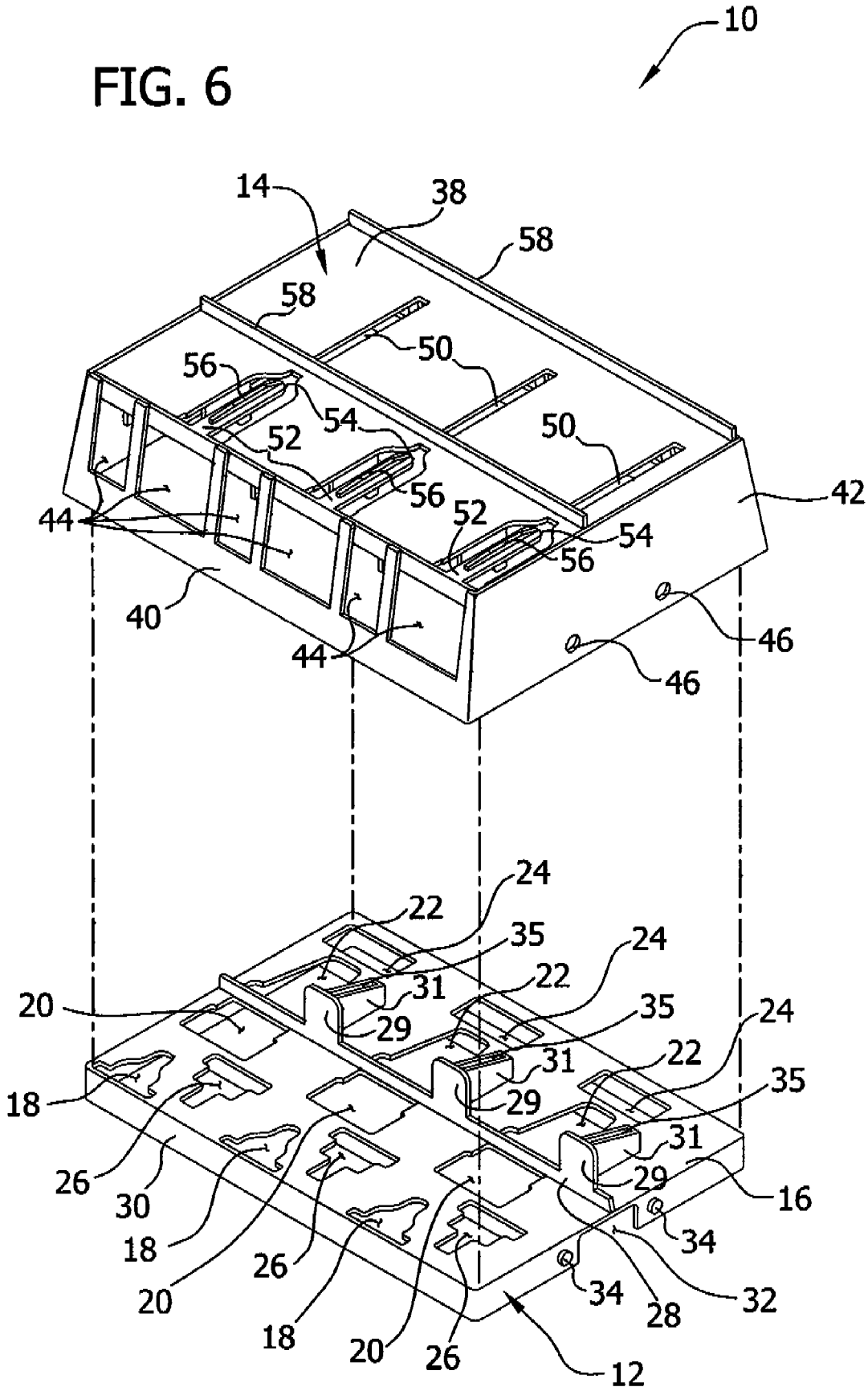
FIG. 6 is an exploded perspective view thereof.

As illustrated in FIG. 6, a rib 28 extends up from the loading surface of the panel 16 generally along a longitudinal axis LA (FIG. 1) of the loading member 12. The rib 28 extends from approximately one end of the loading member 12 to the other. Three longitudinally spaced tabs 29 extend up from the loading surface of the panel along the rib 28 (FIG. 6). For example, the tabs 29 may be formed integrally with the rib 28, or the rib may be formed from multiple pieces that are spaced apart to accommodate positioning of the tabs 29 between the rib pieces. Extending transversely outward from each of the tabs 29 is a pair of spaced-apart tapered walls 31. An end wall 33 spans the spaced-apart tapered walls 31 at their ends opposite from the tabs 29 such that the tabs, tapered walls 31, and end wall 33 define an elongate slot 35 sized and shaped for receiving a disk 95 (FIG. 2) of the bottle assembly 75 (FIG. 11 or 12).

Figure 4:
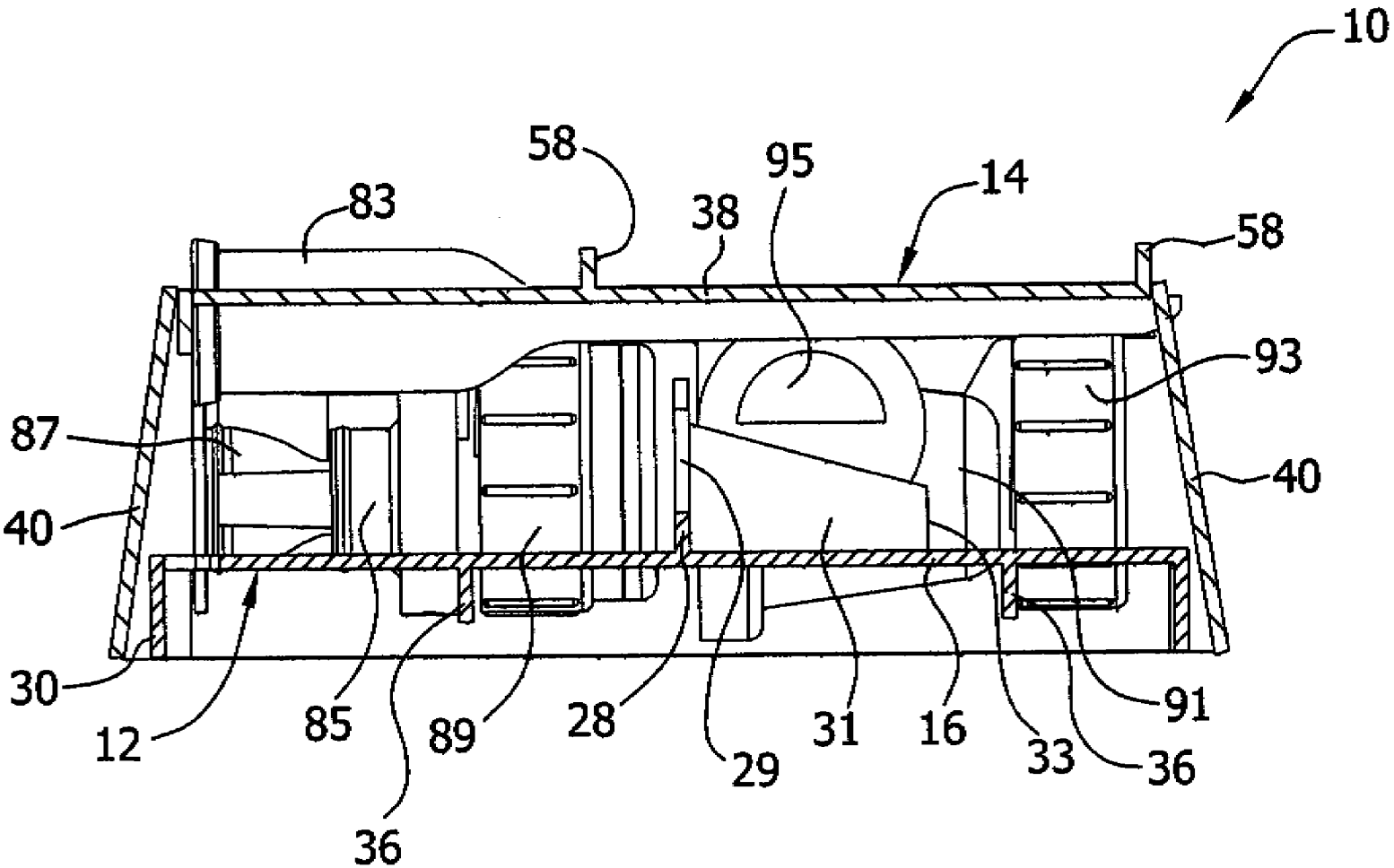
FIG. 4 is a cross-section taken in the plane of line 4-4 of FIG. 3.
Figure 5:
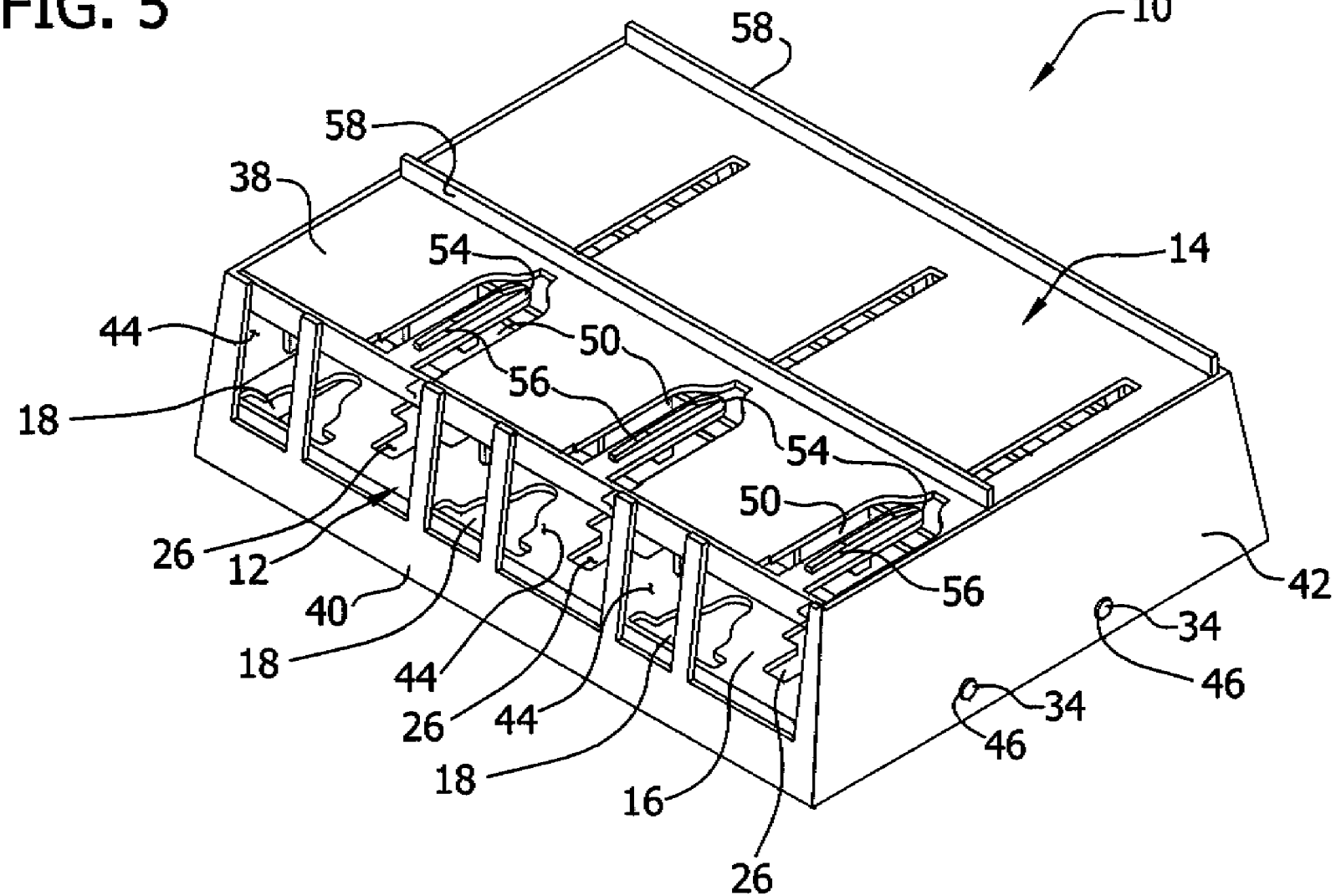
FIG. 5 is a perspective view of the apparatus of FIG. 1 with the various components of the nursing bottle assemblies removed from the apparatus.

With reference again to FIG. 6, it will be understood that the peripheral skirt 30 depending from the panel 16 supports the panel above the surface (e.g., a countertop) on which the loading member is placed during loading to allow sufficient room for the bottle components 80 to properly seat within the openings 18, 20, 22, 24, 26 in the panel as illustrated in FIG. 4. A cut-out 32 (FIG. 2) is provided in the skirt 30 so that a user can grip the retaining member 14 when it is attached to the loading member 12 to facilitate removal of the retaining member from the loading member. The cut-out 32 can also facilitate gripping and picking up the loading member 12 from the supporting surface when the retaining member 14 is not held in assembly with the loading member, and to facilitate holding the loading member 12 while disassembling the retaining member 14 from the loading member following cleaning. While not illustrated in the drawings, additional cut-outs may be provided at locations along the skirt 30.

Figure 8:
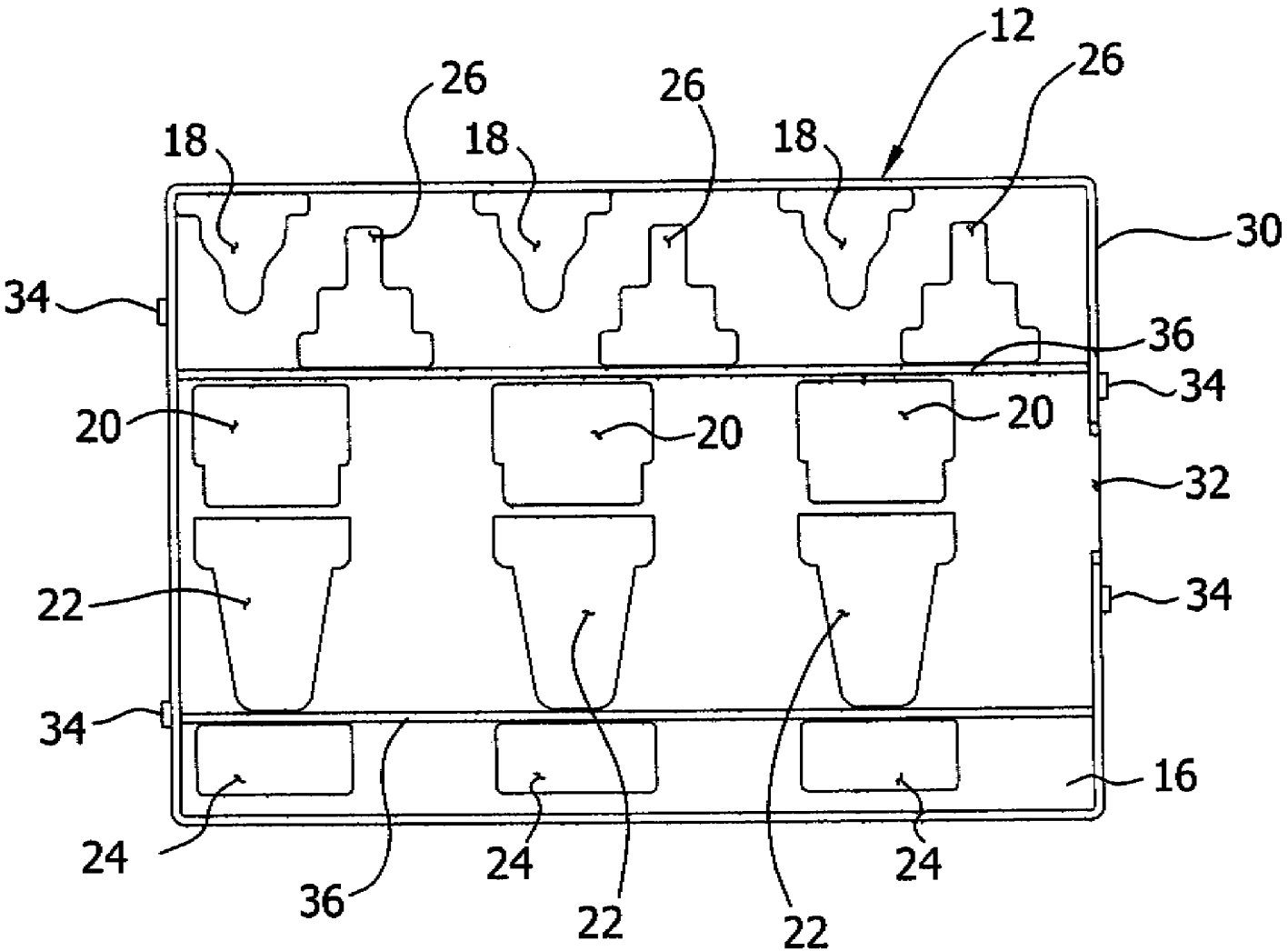
FIG. 8 is a bottom view of the loading member.
Figure 9:
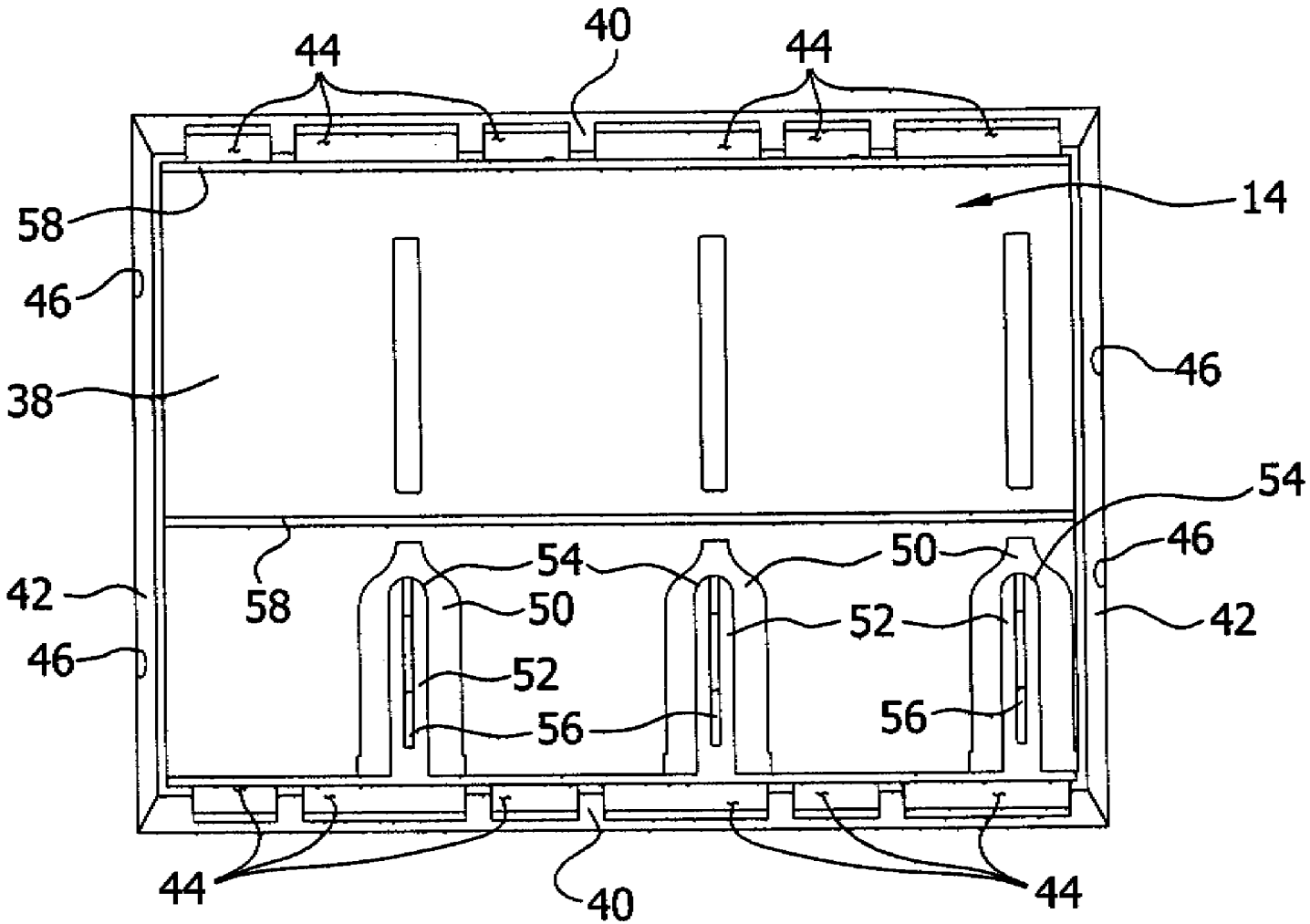
FIG. 9 is a top view of a retaining member of the apparatus.

As illustrated best in FIGS. 4 and 8, a pair of reinforcing ribs 36 depends from the panel 16 and extends longitudinally across the panel, and more suitably to the skirt at opposite sides of the panel for attachment to the skirt as well as the panel. The ribs 36 are suitably located transversely of the panel 16 at locations away from the openings 18, 20, 22, 24, 26. It is understood that the loading member 12 may have more or fewer reinforcing ribs 36, or that the reinforcing ribs 36 may be omitted altogether, without departing from the scope of this invention.

With particular reference now to FIGS. 1-6, 9, and 10, the retaining member 14 suitably comprises (with reference to the orientation of the retaining member as illustrated in FIG. 1) a top wall 38, laterally opposite side walls 40, and longitudinally opposite end walls 42. Each of the side walls 40 and end walls 42 tapers slightly outward they extend downward away from the top wall 38 to defining an open bottom of the retaining member 14 that is sized slightly larger than the loading member 12 for seating the retaining member down over the loading member.

The side walls 40 have a plurality of openings 44 formed therein to permit water in the dishwasher to flow into and outward from the apparatus 10 to clean the bottle components 80 held by the apparatus. For example, in the illustrated embodiment six generally rectangular openings 44 are formed in each of the side walls 40. However, the size, shape and/or number of openings 44 may vary without departing from the scope of this invention. Moreover, the end walls 42 are illustrated as not having any openings formed therein for water flow through, however it is contemplated that openings may be formed in the end walls of the retaining member 14 and remain within the scope of this invention. It is contemplated that one or more openings may also be formed in the top wall 38 of the retaining member 14. In alternative embodiments (not shown), the top wall 38 and or side and end walls 40, 42 of the retaining member 14 may be constructed to have a grid or mesh pattern.

Figure 10:
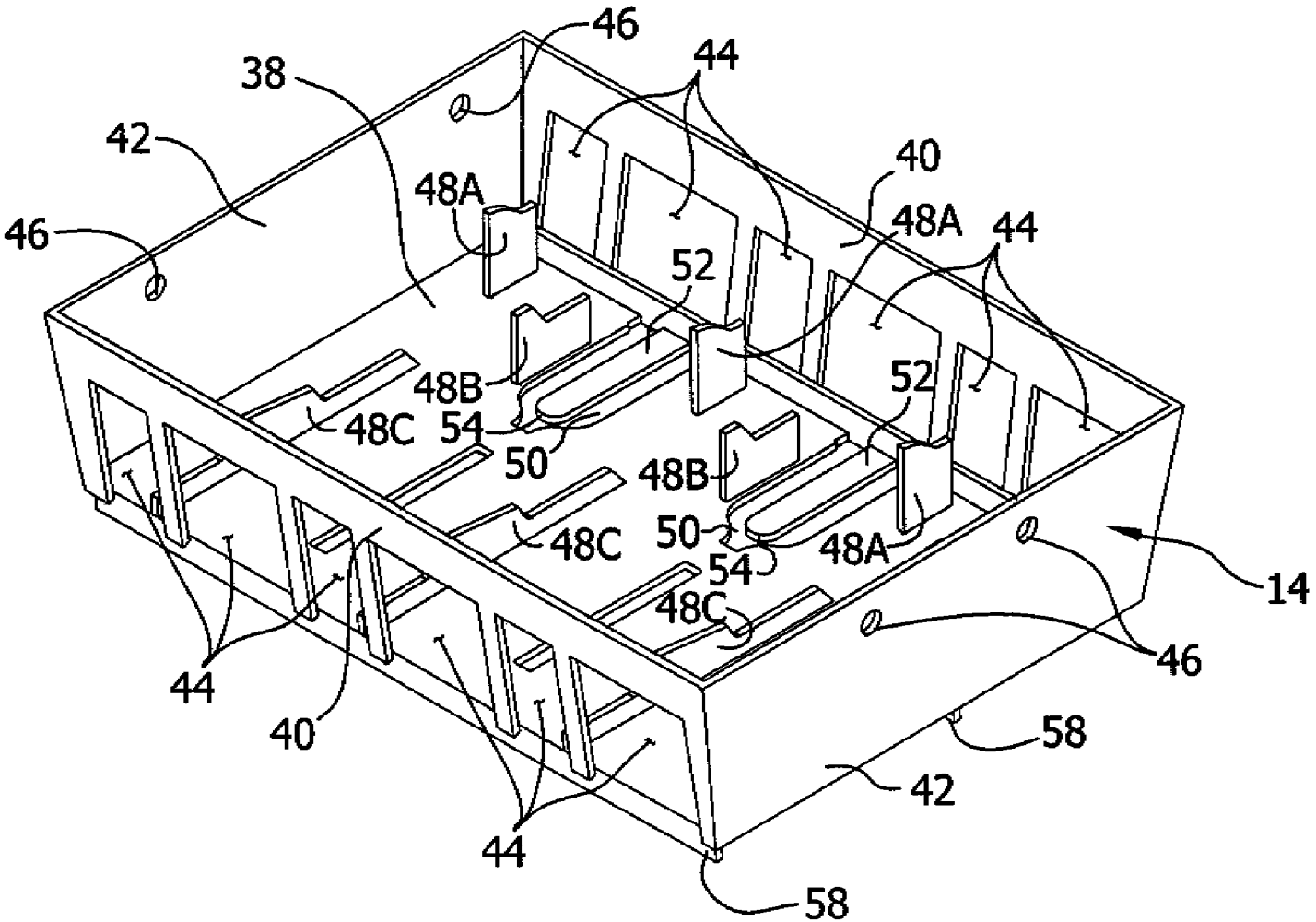
FIG. 10 is a perspective view of the retaining member as illustrated from the bottom of the assembly.

With particular reference to FIG. 10, attached to and depending from the top wall 38 are three sets of laterally extending ribs, such as ribs 48A adjacent one of the side walls 40, ribs 48B spaced laterally from the one side wall, and ribs 48C adjacent the opposite side wall of the retaining member 14. The ribs 48A, 48B, 48C are configured to extend down into closely spaced or even contacting relationship with the various bottle components 80 on the loading member 12 when the retaining member is assembled with the loading member to inhibit movement of the bottle components in the apparatus 10 during cleaning in the dishwasher. For example, the ribs 48A are designed to retain the nipples 87 in place; the ribs 48C are designed to retain the collar 89, cap 91 and a closure or travel cap 93 in place; and the ribs 48B are designed to retain the vent insert 85 in place. As such, upon assembly of the retaining member 14 with the loading member 12, the apparatus 10 may be oriented in any manner within the dishwasher, such as with the loading member down, the retaining member down, or the entire apparatus oriented on its side. In the illustrated apparatus 10, however, it is preferred that the side wall 40 adjacent the nipples 87 is positioned against the upper rack of the dishwasher so that the components 80 of the bottle assemblies 75 adequately drain.

The top wall 38 of the retaining member 14 also includes three sets of openings 50. Each of the openings 50 is sized and shaped for receiving the same component from each of the bottle assemblies 75. For example, in the illustrated embodiment the openings 50 are each sized and shaped for receiving the elongate tubes 83 from each of the bottle assemblies 75. A tab 52 extends laterally from the top wall 38 into each of the openings 50 for mounting the elongate tubes 83 in the openings. Each of the tabs 52 includes a rounded edge 54 for allowing the elongate tube 83 to slide onto the tab and an upwardly extending flange 56 for spacing most of the tube out of contact with the tab.

A pair of laterally spaced reinforcing members 58 (FIGS. 1 and 6) extend longitudinally along the top wall 38 to strengthen the retaining member 14. The reinforcing members 58 suitably extend approximately the entire length of the top wall 38. In particular, one of the reinforcing members 58 is positioned adjacent one of the side walls 40 while the other is more centrally located on the top wall 38. It is understood, though, that the top wall 38 can have more or fewer reinforcing members 58, and that the reinforcing members may be located on the top wall 38 at positions other than as shown in the illustrated embodiments without departing from the scope of this invention. It is also understood that the reinforcing members 58 may be omitted from the retaining member 14.

The retaining member 14 is selectively positionable relative to the loading member 12 between an open position in which the loading surface defined by the panel 16 of the loading member is uncovered by the retaining member and therefore accessible for loading and unloading of the bottle components 80, and a closed position in which the retaining member seats down over the loading member to hold the bottle components 80 in place during cleaning.

In one particularly suitable embodiment the retaining member 14 is entirely separable from the loading member 12 in the open position of the retaining member as illustrated in FIG. 2. In such an embodiment, a suitable fastening system is provided to releasably secure the retaining member 14 and loading member 12 in assembly with each other in the closed position of the retaining member. For example, the fastening system of the illustrated embodiment comprises a pair of detents 34 (FIG. 3) secured to and extending outward from the skirt 30 at each of the longitudinal ends of the loading member 12. A corresponding pair of openings 46 is formed in each of the end walls 42 of the retaining member 14. Upon assembly of the retaining member 14 with the loading member 12, the detents 34 seat within the openings 46 to releasably secure the retaining member in assembly with the loading member.

Although two detents 34 and corresponding openings 46 are used as the fastening system in the illustrated embodiment, it is understood that any number of detents may be used, and that the detents may be disposed on the sides of the loading member skirt 30 instead of or in addition to being on the ends thereof. It is also understood that the detents 34 may be on the retaining member 14 and the corresponding openings may be on the skirt 30 of the loading member 12. It is also contemplated that fastening systems other than detent/opening fastenings may be used to releasably secure the retaining member 14 and the loading member 12 in assembly with each other.

Figure 3:
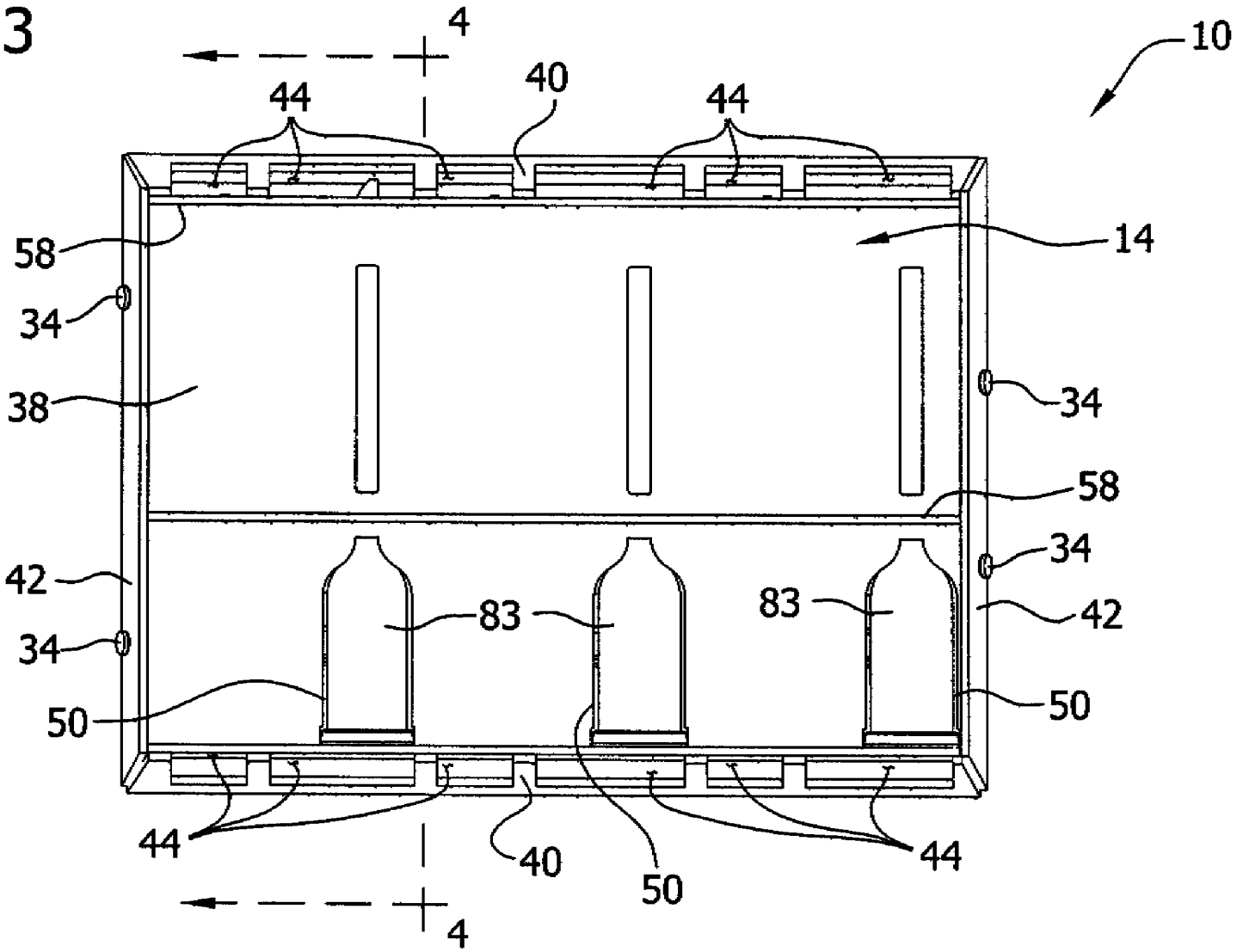
FIG. 3 is a top view of the apparatus of FIG. 1.

In one particularly suitable embodiment, the fastening system is configured so that the retaining member 14 is positionable on the loading member 12 in only one orientation of the retaining member to properly fasten the retaining member to the loading member. For example, in the illustrated embodiment of FIG. 3 the detents 34 (and corresponding openings 46) at one end of the apparatus 10, such as the left end in FIG. 3, are spaced from each other a greater distance than the detents (and corresponding openings) at the opposite end of the apparatus (e.g., the right end in FIG. 3). Accordingly, the retaining member 14 can only properly fasten to the loading member when the retaining member is oriented with the wider spaced openings 46 at the same end as the wider spaced detents 34 of the loading member. By requiring this orientation, the retaining member is properly positioned on the loading member to positively hold the bottle components 80 in the apparatus during cleaning.

As illustrated in FIG. 7, the loading member 12 can include indicia 60 thereon for facilitating identification of the respective opening 18A-26C as being the proper location for the placement of the respective component. For example, the indicia 60 can be the respective names of the component intended to be placed into the opening 18A-26C. The indicia 60 could also include a color, picture, number, or any other indicia that can be used to identify the component intended to be placed in the respective opening 18A-26C. Indicia (not shown) can also be placed on the retaining member 14 to identify which component(s) of the bottle assemblies 75 are intended to be seated in the openings 50 in the retaining member.

FIGS. 13-24 illustrate a second embodiment of the apparatus, generally indicated at 110 similar to the apparatus 10 of the first embodiment except that the apparatus is suitably configured to hold bottle components 180 (e.g., components 183, 185, 187, 189, 191, 193, 195, other than bottle 177) of a wide-neck type nursing bottle assembly 175 such as that available from Handi-Craft Company of Saint Louis, Mo. under the tradename DR. BROWN'S NATURAL FLOW. As a result, the apparatus, including the loading member 112 and retaining member 114 are sized and shaped differently than the corresponding parts of the apparatus 10 to accommodate the different sized and shaped bottle components 180. Parts of the apparatus 110 and bottle assemblies 175 shown in FIGS. 13-24 corresponding to parts of the apparatus 10 and bottle assemblies 75 shown in FIGS. 1-12 are identified using the same references number plus "100".

Figure 24:
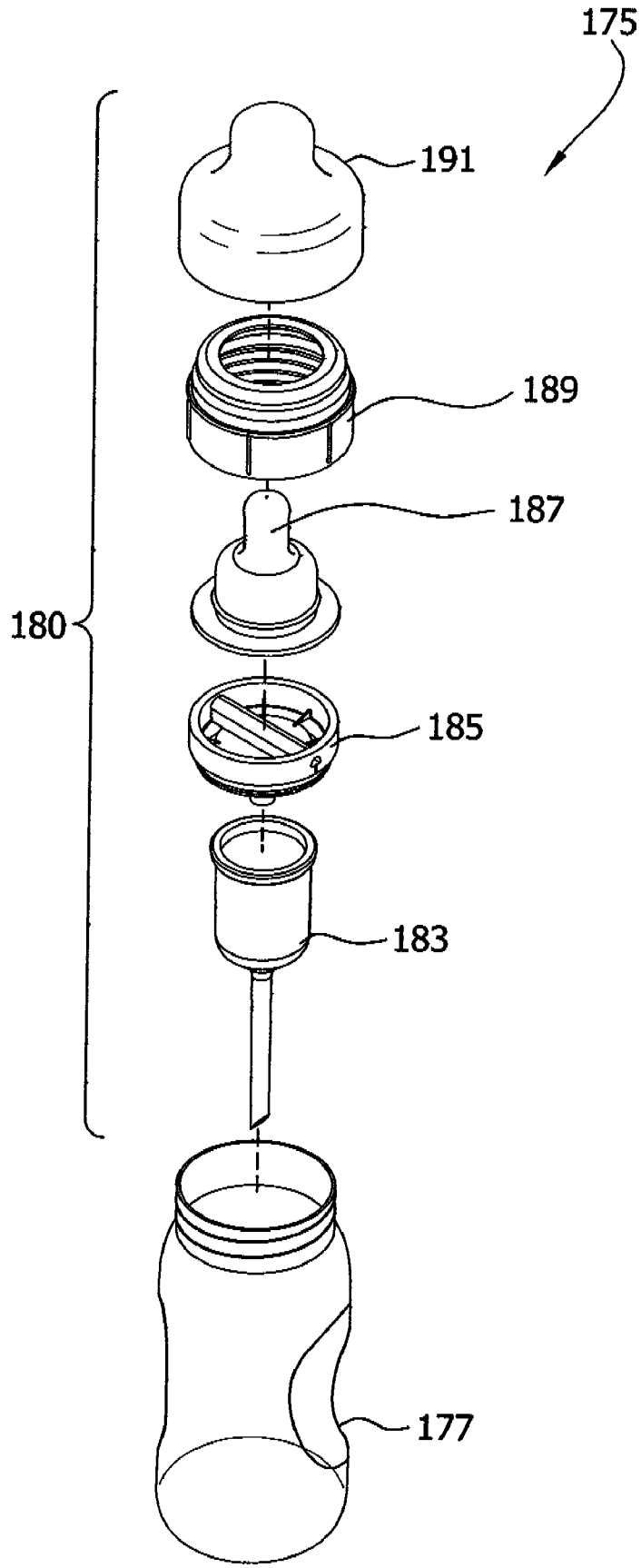
FIG. 24 is an exploded perspective view of the nursing bottle of FIG. 23.
Figure 25:
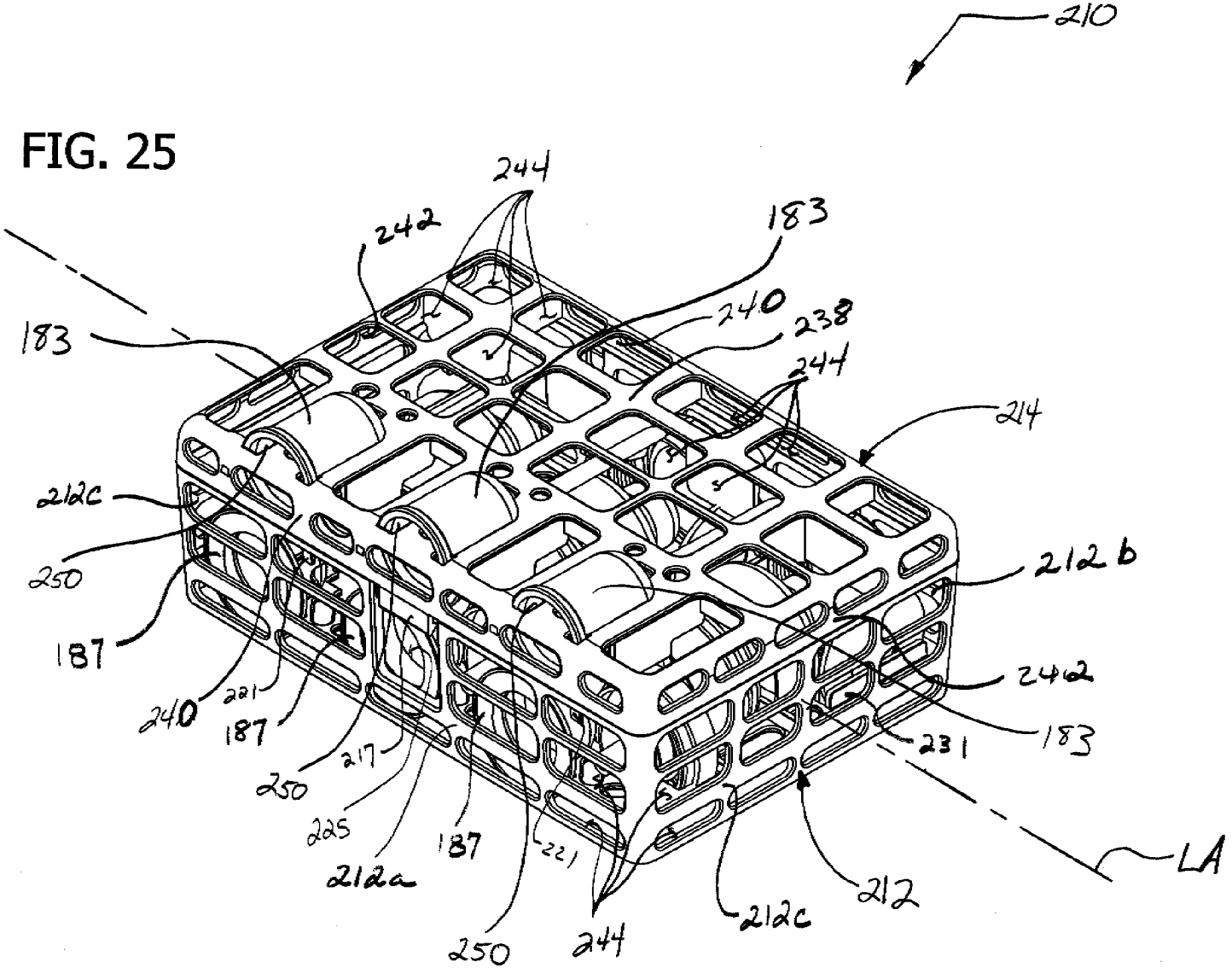
FIG. 25 is a perspective view of a third embodiment of apparatus for holding one or more components of a nursing bottle assembly.

FIGS. 25-34 illustrate a third embodiment of the apparatus, generally indicated at 210. The apparatus of this embodiment is suitably constructed to accommodate bottle components, such as the components of the nursing bottle assembly 175 illustrated in FIG. 23 which, as mentioned above, is commercially available from Handi-Craft Company of St. Louis, Mo. under the tradename DR. BROWN'S NATURAL FLOW. More particularly, the apparatus 210 is configured to accommodate all of the bottle components of multiple nursing bottle assemblies. For example, the apparatus 210 illustrated in FIG. 25 is configured to accommodate all of the bottle components 180 of three of the nursing bottle assemblies 175 illustrated in FIGS. 23 and 24. It is understood, however, that the apparatus 210 may be configured to receive the bottle components of one, two, or more than three nursing bottle assemblies and remain within the scope of this invention.

The apparatus 210 comprises a loading member, generally indicated at 212, on which the bottle components 180 to be cleaned are initially loaded, and a retaining member, indicated generally at 214, for being held in assembly with the loading member and configured to hold the bottle components 180 separate from each other and generally stationary during cleaning of the bottle components in the dishwasher. The apparatus 210 is suitably sized and shaped for placement in an upper rack of the dishwasher.

Figure 28:
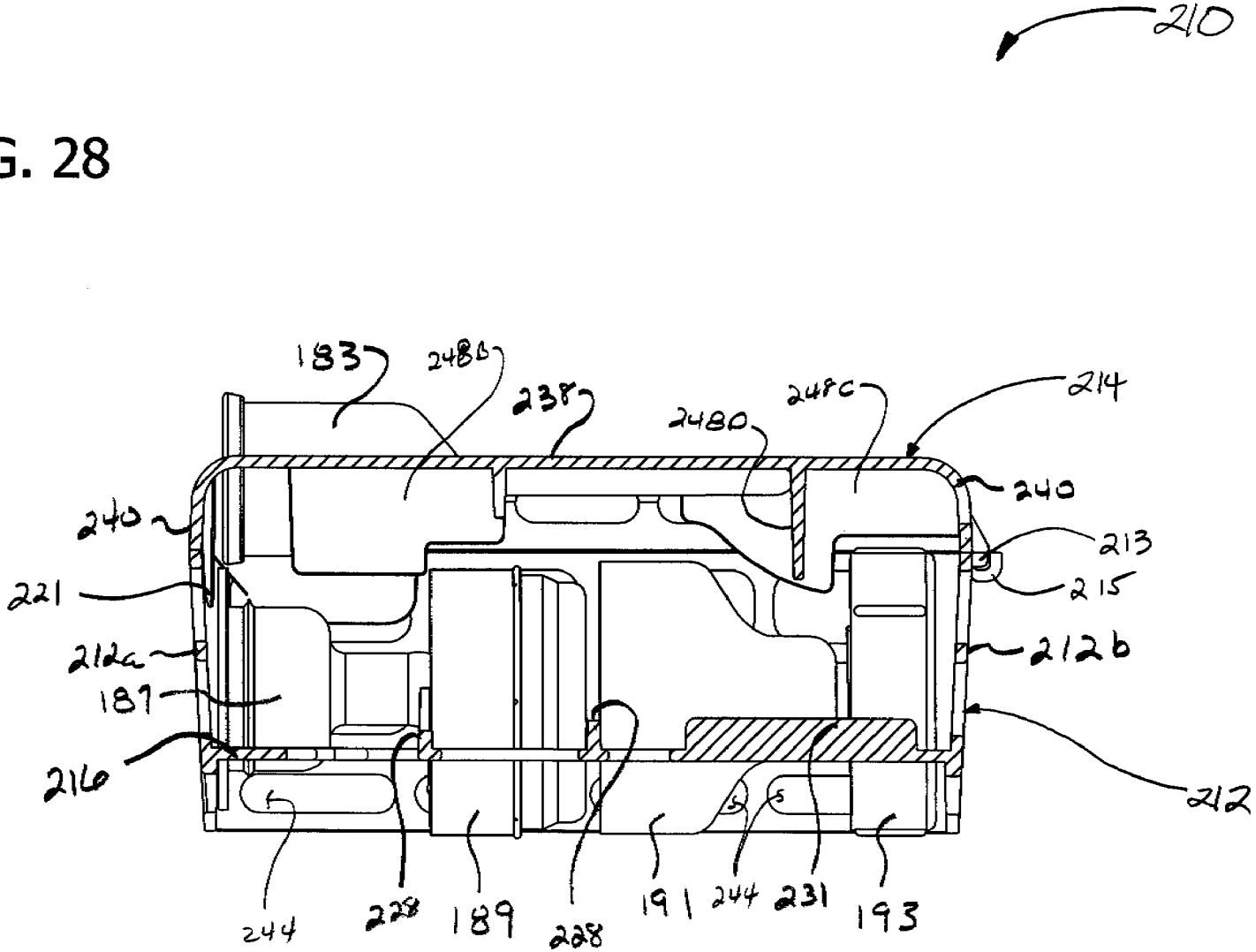
FIG. 28 is a cross-section taken in the plane of line 28-28 of FIG. 27.
Figure 29:
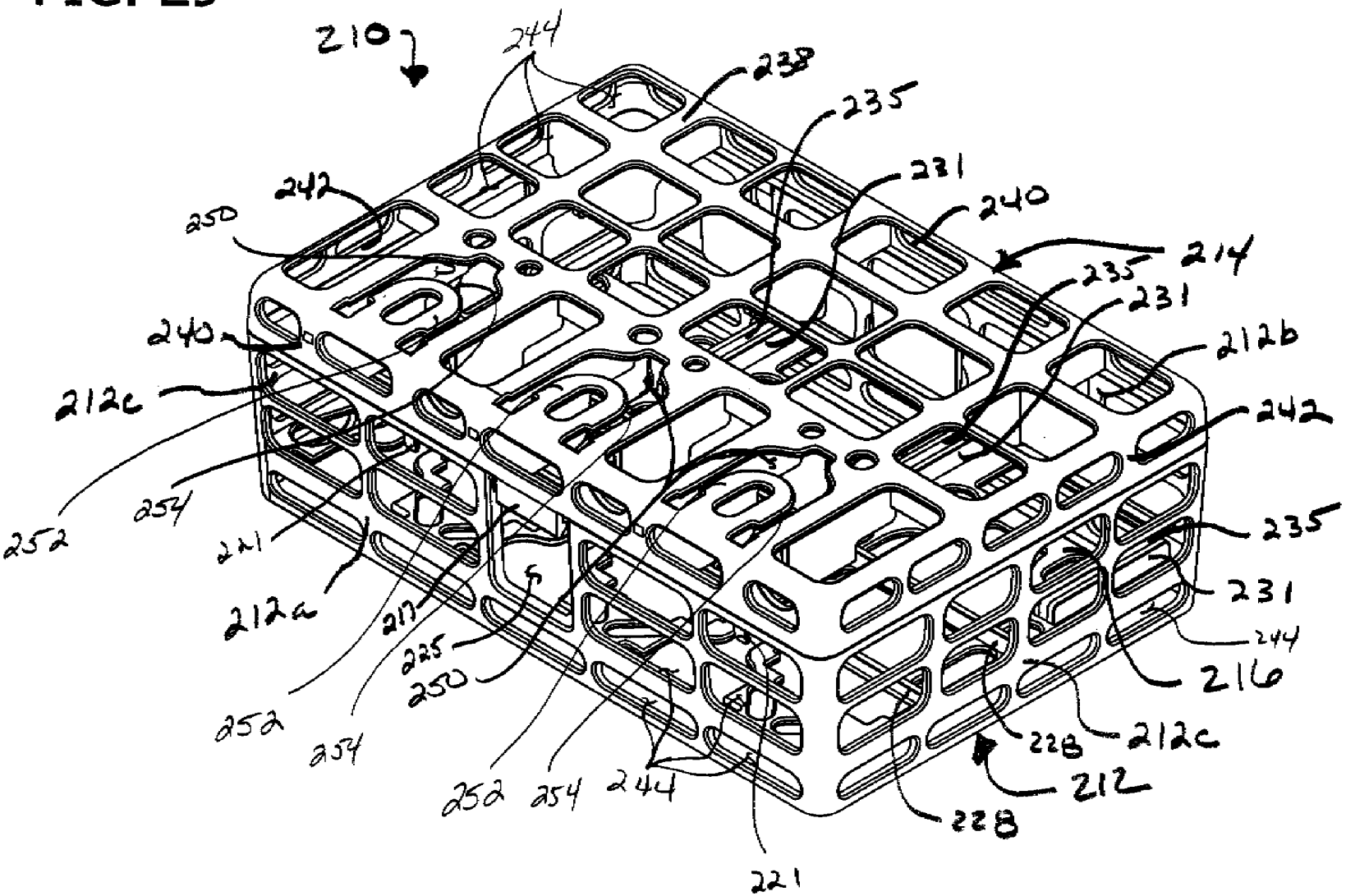
FIG. 29 is a perspective view of the apparatus of FIG. 25 with the various components of the nursing bottle assemblies omitted from the apparatus.

As illustrated in FIGS. 26, 28, and 30-32, the loading member 212 comprises a generally rectangular panel 216, a front wall 212*a*, a rear wall 212*b*, and end walls 212*c* (collectively "loading member walls"). Each of the loading member walls 212*a*, 212*b*, 212*c* are intersected along their height by the panel 216. As a result and with reference to FIG. 28, the loading member walls 212*a*, 212*b*, 212*c* cooperatively support the panel 216 above the surface (e.g., a countertop) on which the loading member 212 is placed during loading to allow sufficient room for the bottle components 180 to properly seat within the respective openings 218, 220, 222, 224, 226 in the panel as illustrated in FIG. 28. The loading member walls 212*a*, 212*b*, 212*c* may be formed as one-piece with the panel 216, such as by being molded therewith, or the loading member walls may be formed separate from the panel and adhered, welded, bonded, or otherwise suitably secured thereto. The panel 216 of the loading member 212 has an upper, loading surface onto which the bottle components 180 of the nursing bottle assemblies 175 are arranged to properly load the bottle components into the apparatus 210.

In particular, multiple openings 218, 220, 222, 224, 226 are formed in the panel 216 for positive seating of the various bottle components 180 on the loading surface defined by the panel. One set of openings 218 (broadly, first openings) is sized and configured for receiving a portion of the one bottle components 180, such as the nipple 187. Another set of openings 220 (broadly, second openings) is sized and configured for receiving a portion of a different one of the bottle components 180, such as the collar 189. The other sets of openings 222, 224, 226 are each sized and configured for receiving a portion of the cap 191, closure 193, and vent insert 185, respectively.

In one embodiment, the openings 218, 220, 222, 224, 226 each differ in at least one characteristic that is indicative of the particular bottle component 180 that is to be seated in the respective opening. That is, each of the openings 218, 220, 222, 224, 226 is thus associated with a respective bottle component such that the person loading the apparatus 210 can readily identify in which opening a particular bottle component 280 is to be placed. For example, in the illustrated embodiment (FIG. 31), the openings 218, 220, 222, 224, 226 have different shapes, with each of the openings being configured to have a shape that corresponds generally to the profile of the respective bottle component 180 that is to be seated in the opening. For example, the openings 218 of the illustrated embodiment are each shaped to correspond generally to the profile of the nipple 187 while the openings 220 are each shaped to correspond generally to the profile of the collar 189. It is understood, however, that the openings 218, 220, 222, 224, 226 are each sized smaller than the actual profile of the respective bottle component 180 so that the bottle component properly seats on the panel 216 partially within the opening without falling entirely through the opening. It is understood, however, the openings can be sized equal to or even greater than the profile of the respective bottle component and the component can be prevented from failing through the opening using ribs, screens, or other suitable methods.

Figure 23:
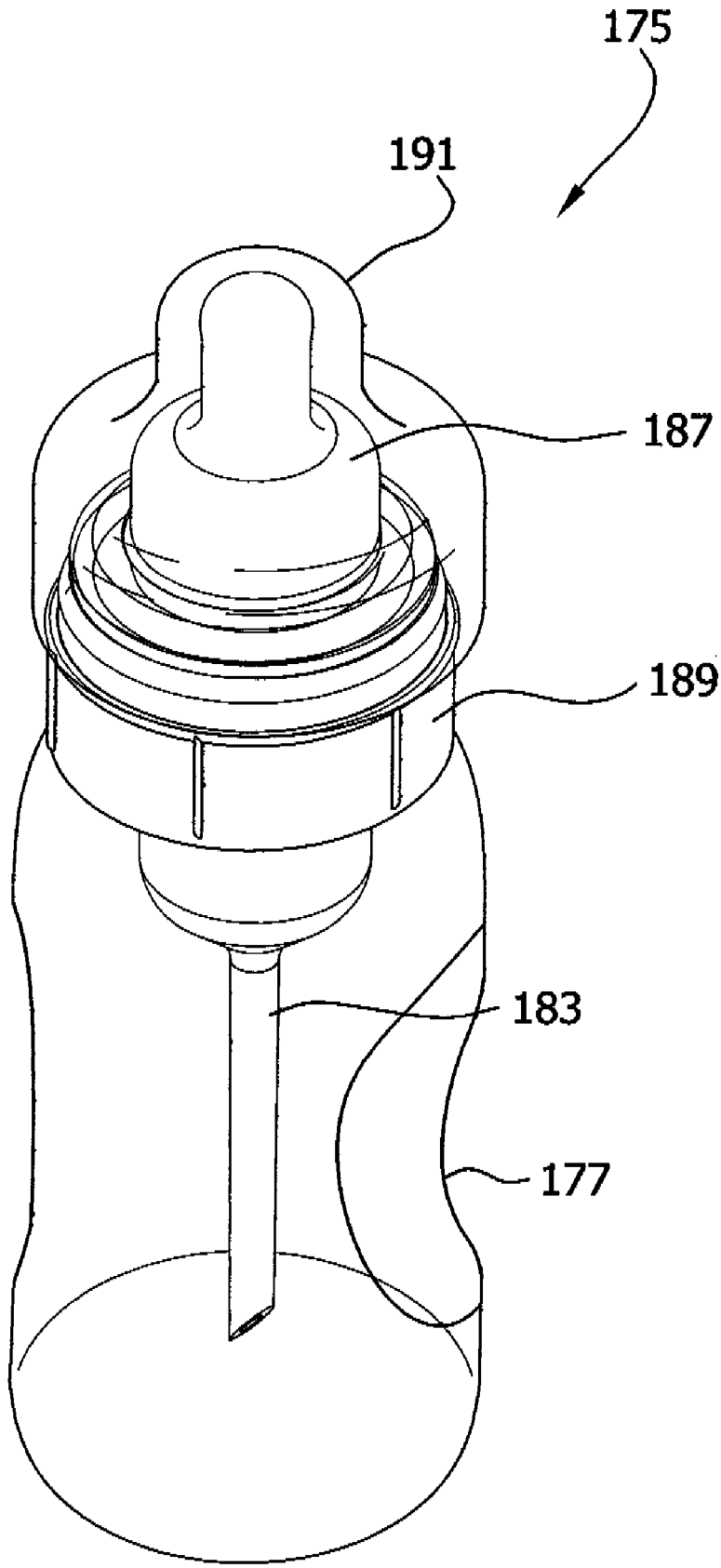
FIG. 23 is a perspective view of another nursing bottle assembly in an assembled condition.
Figure 30:
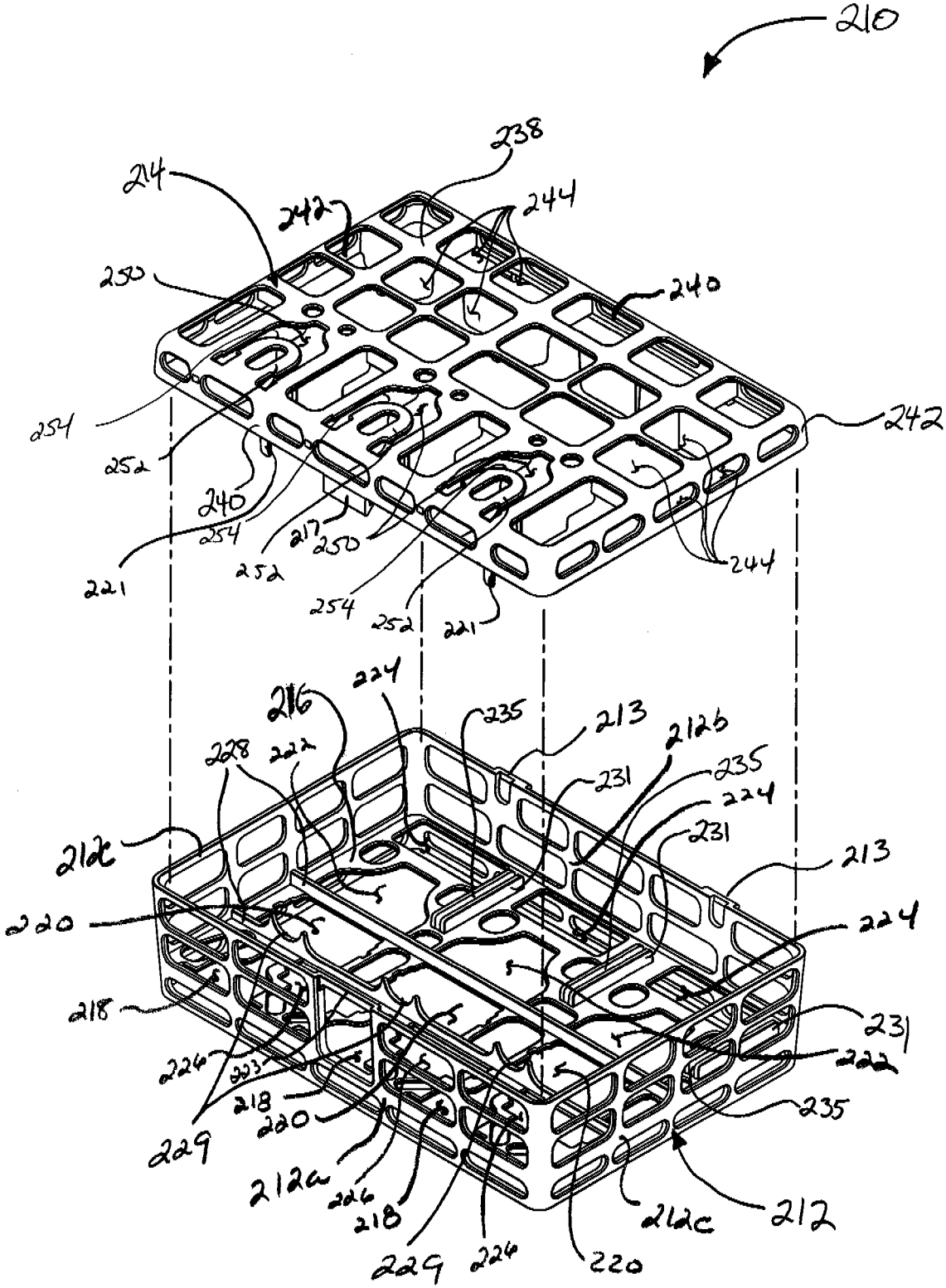
FIG. 30 is a perspective view of the apparatus of FIG. 25 with the retaining member exploded from the loading member.
Figure 31:
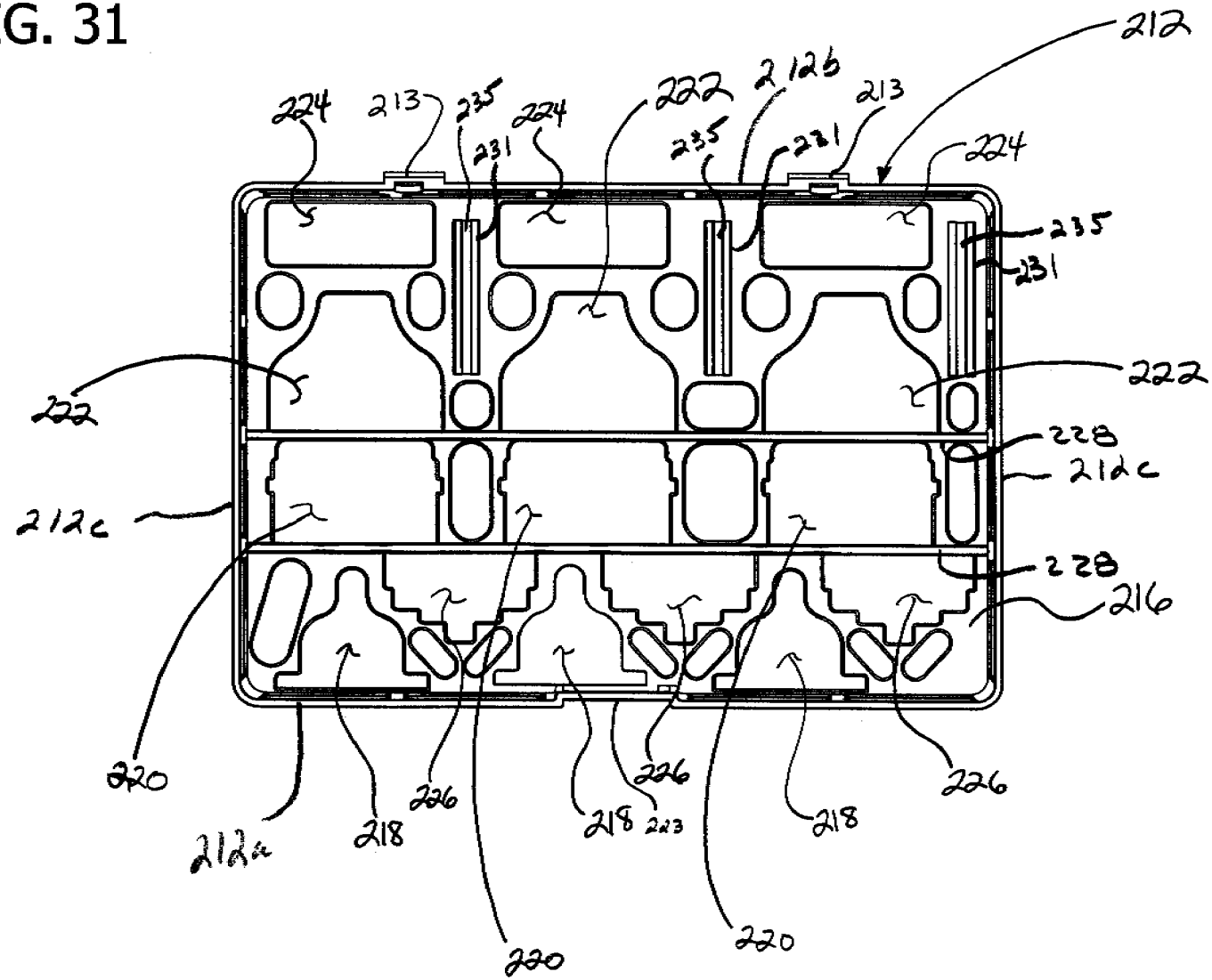
FIG. 31 is a top view of the loading member of the apparatus of FIG. 25.
Figure 32:
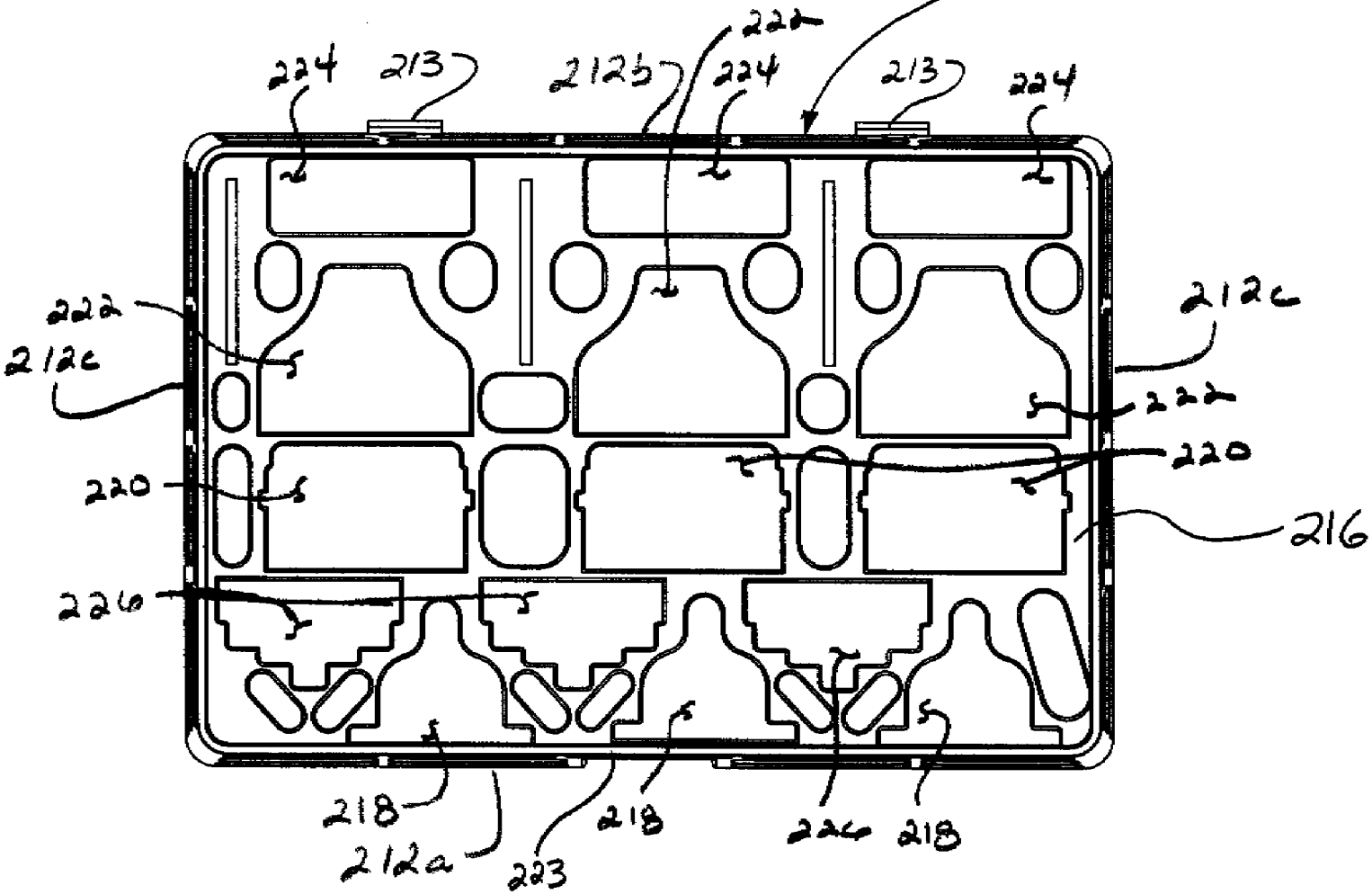
FIG. 32 is a bottom view thereof.

As illustrated in FIG. 30, a pair of ribs 228 extends up from the loading surface of the panel 216. The ribs 228 extend from approximately one end of the panel to the other, and more suitably between each of the end walls 212*c* of the loading member 212. One of the ribs 228 includes three upward facing cradles 229 formed therein but it is understood that the rib could have more or fewer cradles than three depending on the number of components to be accommodated. For example, each of the illustrated cradles 229 are sized and shaped for supporting a portion of the nipple 187 of the bottle assembly 175. As illustrated best in FIGS. 30 and 31, three longitudinally spaced tab pairs 231 extend up from the loading surface of the panel. Each tab pair 231 defines an elongate slot 235 sized and shaped for receiving the disk 195 (FIG. 26) of the bottle assembly 175 (FIGS. 23 and 24).

With particular reference now to FIGS. 25-30, 33, and 34, the retaining member 214 comprises (with reference to the orientation of the retaining member as illustrated in FIG. 25) a top wall 238, laterally opposite side walls 240, and longitudinally opposite end walls 242 (collectively "retaining member walls"). Each of the side walls 240 and end walls 242 extends downward away from the top wall 238 to define an open bottom of the retaining member 214 that is sized for seating the retaining member on top of the loading member 212, so that the bottom of the retaining member walls mate with the top of the loading member walls 212*a*, 212*b*, 212*c*.

As illustrated in FIGS. 25-30, the loading member walls 212*a*, 212*b*, 212*c*, the retaining member walls 240, 242, and the loading member panel 216 have a plurality of openings 244 formed therein to permit cleaning solution (i.e., soapy water) and water to flow into and out of the apparatus 210 to cleanse the bottle components 180 held by the apparatus during operation of the dishwasher. In the illustrated embodiment, for example, approximately one hundred eighteen (118) generally rectangular openings 244 are formed in the apparatus. However, the size, shape, and/or number of openings 244 may vary without departing from the scope of this invention.

Figure 26:
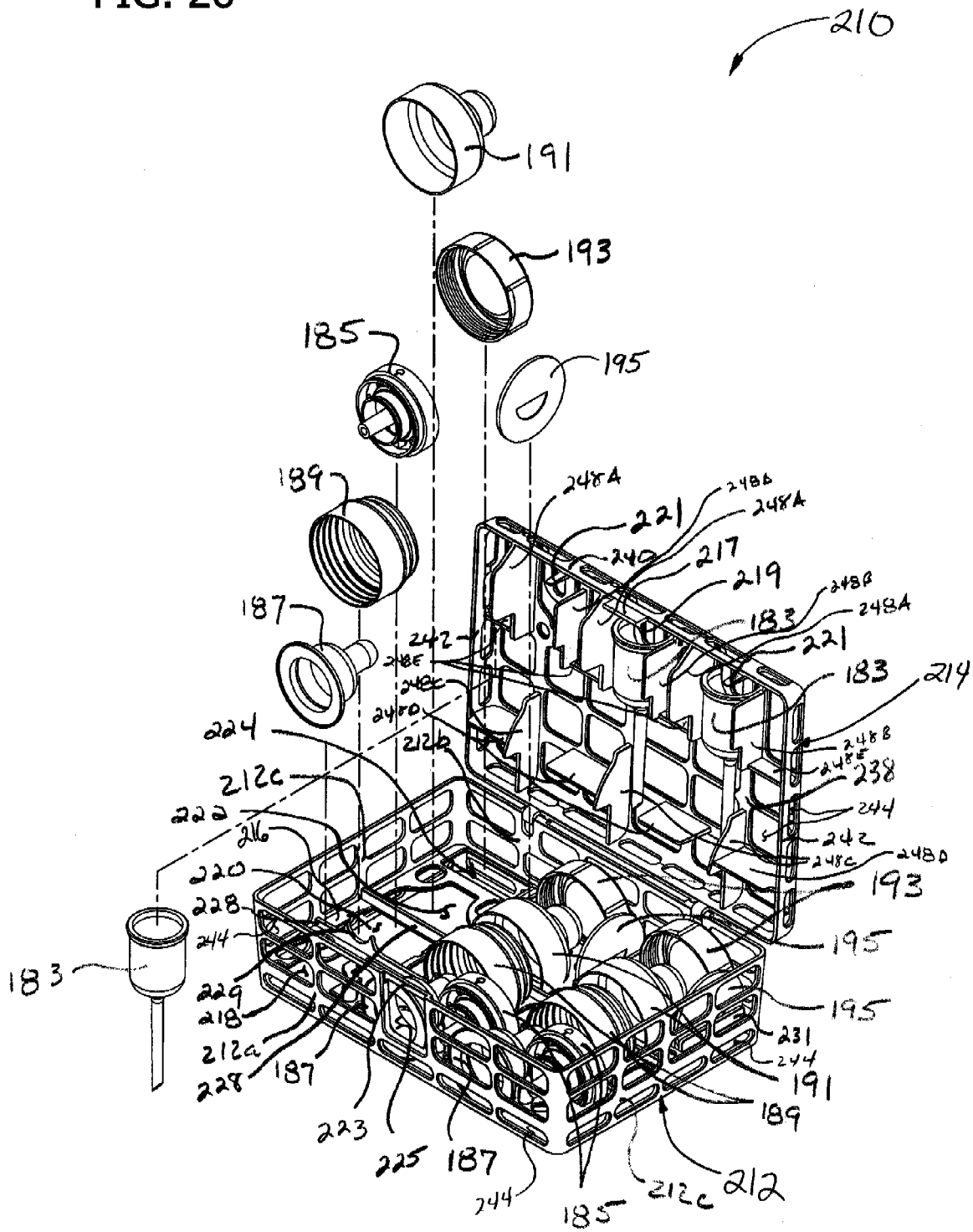
FIG. 26 is an exploded perspective view of the apparatus of FIG. 25 with various components of one nursing bottle assembly exploded from a loading member of the apparatus while the components of two other nursing bottle assemblies are arranged on the loading member.
Figure 27:
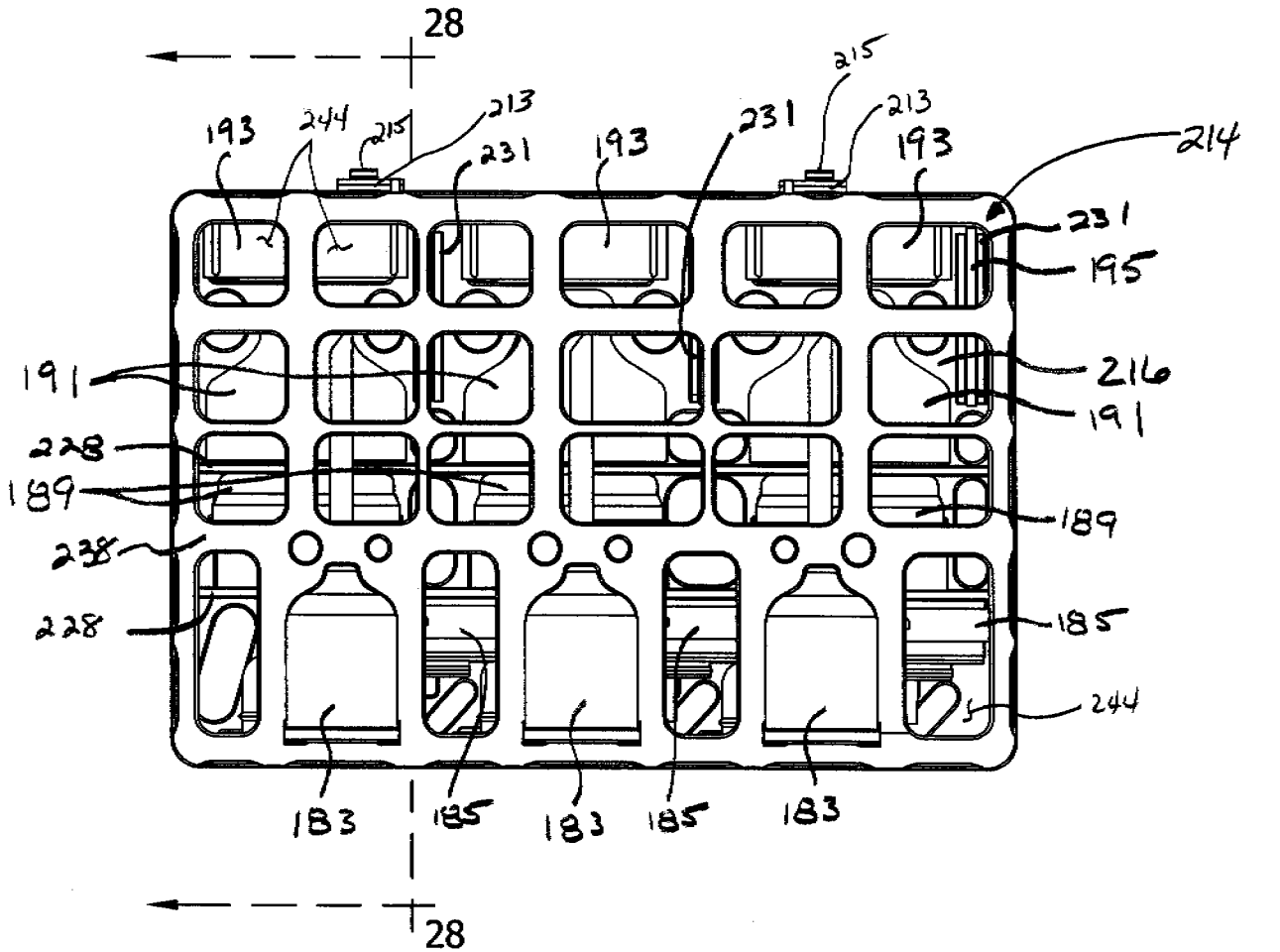
FIG. 27 is a top view of the apparatus of FIG. 25 with a retaining member of the apparatus being in a closed position.
Figure 34:
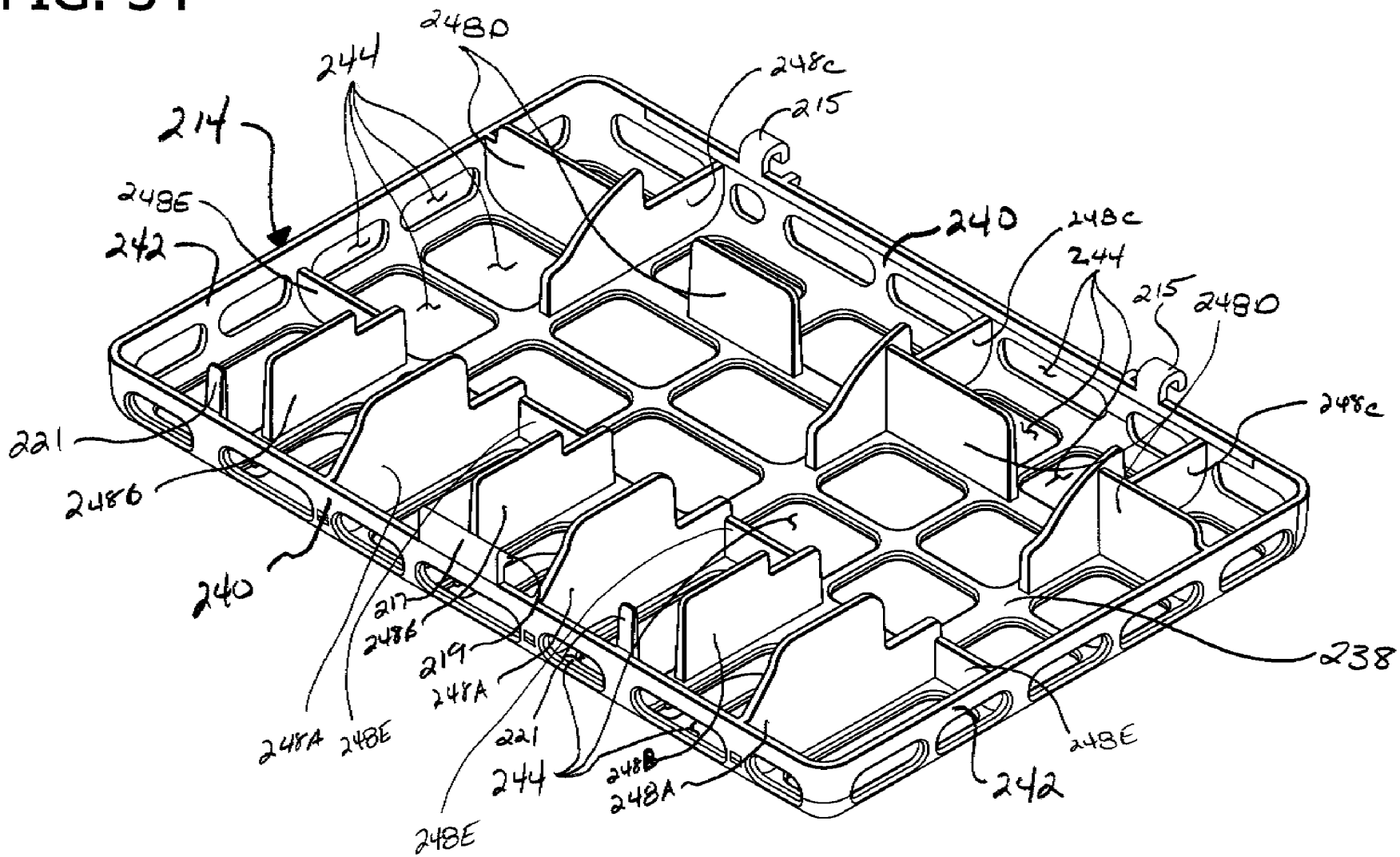
FIG. 34 is a bottom perspective thereof.
Figure 35:
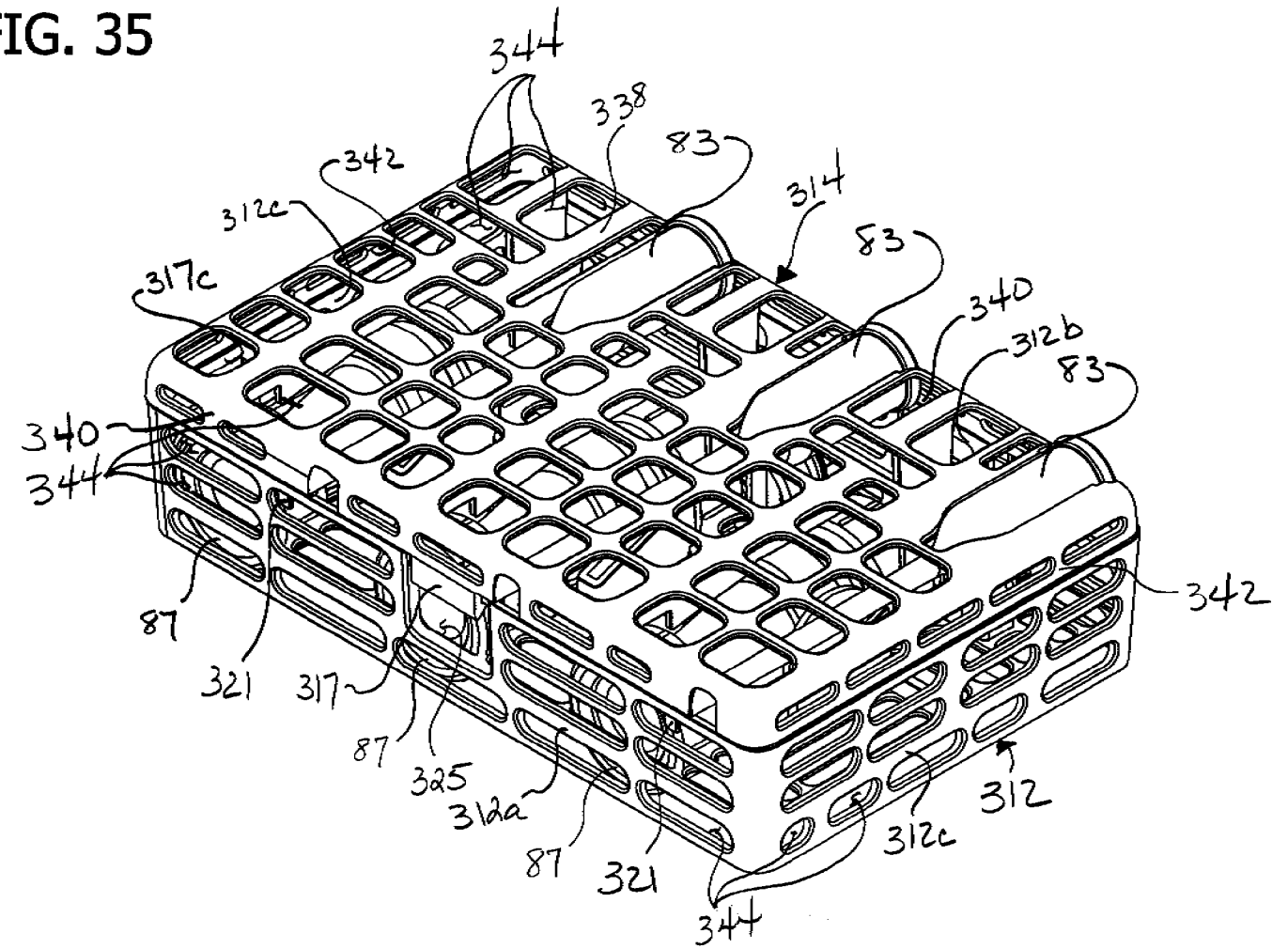
FIG. 35 is a bottom perspective view thereof.
Figure 36:
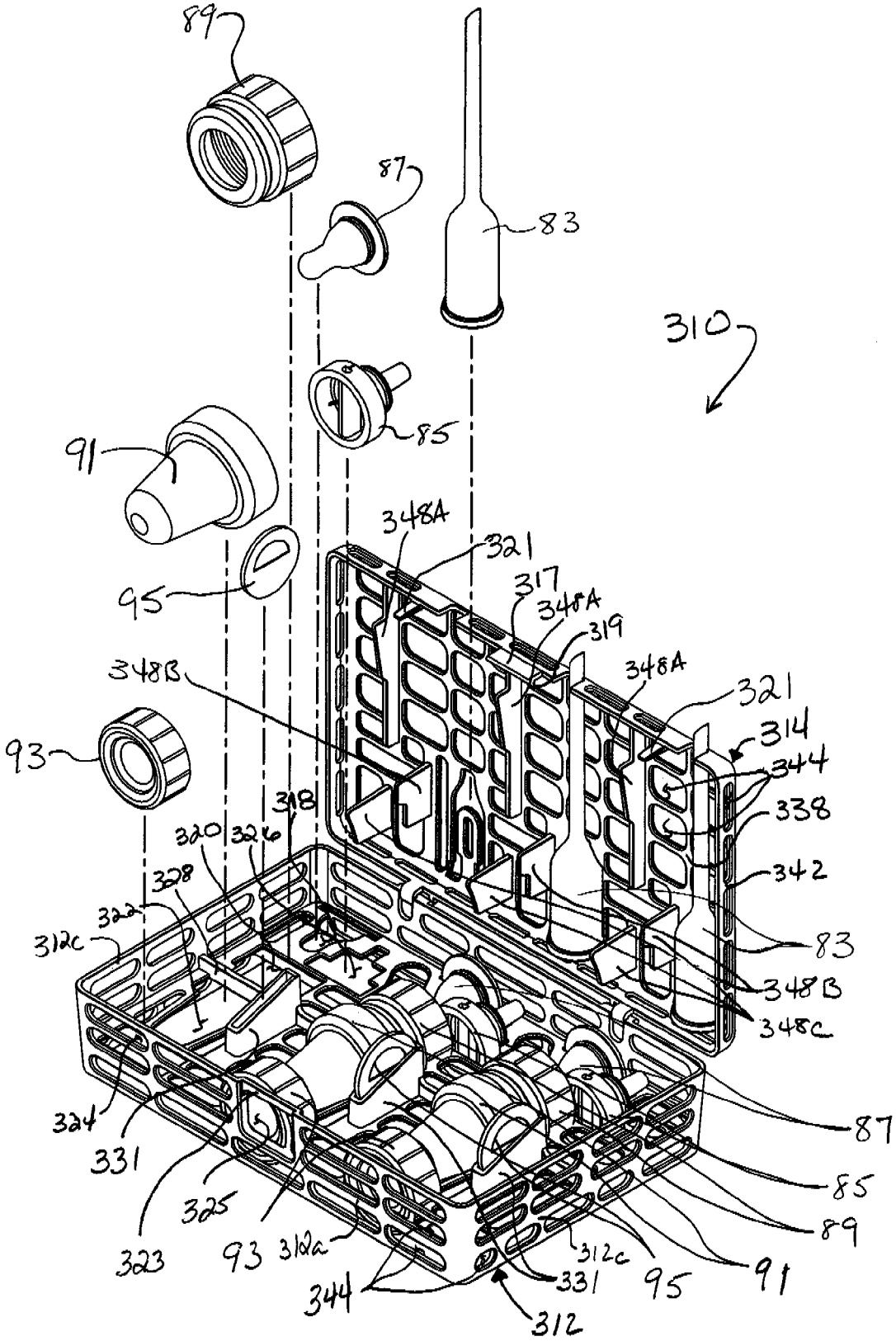
FIG. 36 is an exploded perspective view of the apparatus of FIG. 35 with various components of one nursing bottle assembly exploded from a loading member of the apparatus while the components of two other nursing bottle assemblies are arranged on the loading member.
Figure 37:
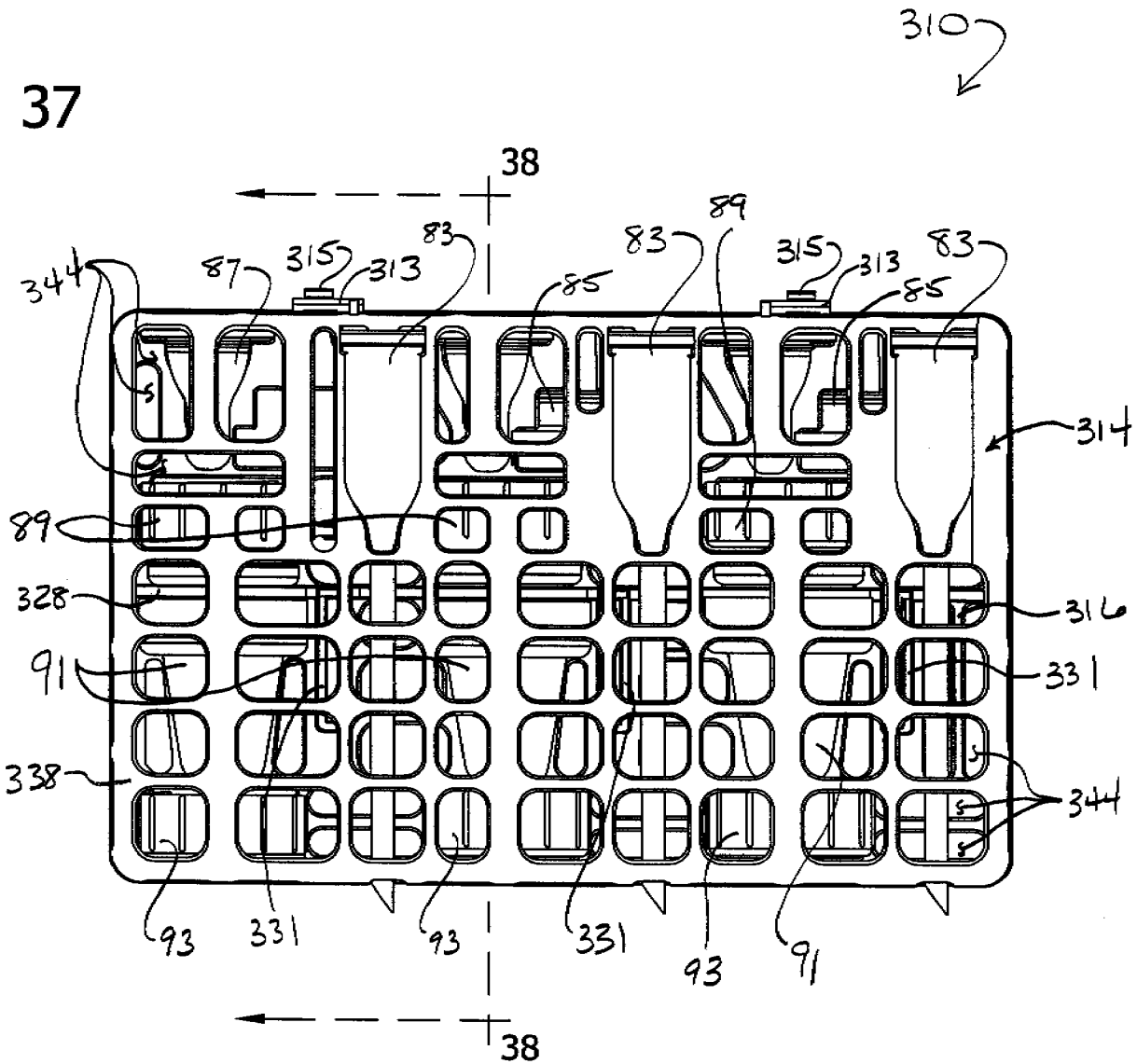
FIG. 37 is a top view of the apparatus of FIG. 35.
Figure 38:
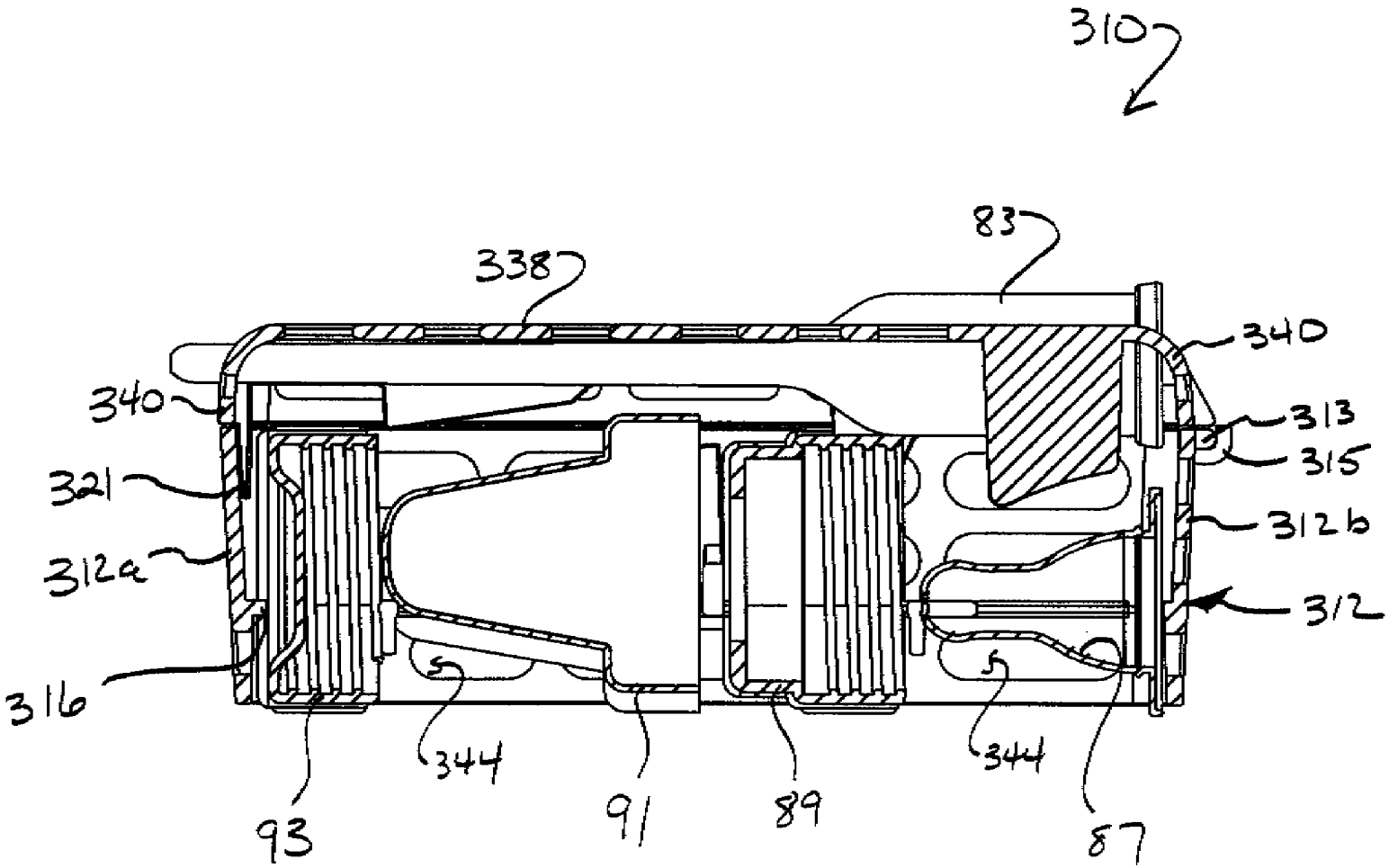
FIG. 38 is a cross-section taken in the plane of line 38-38 of FIG. 37.
Figure 39:
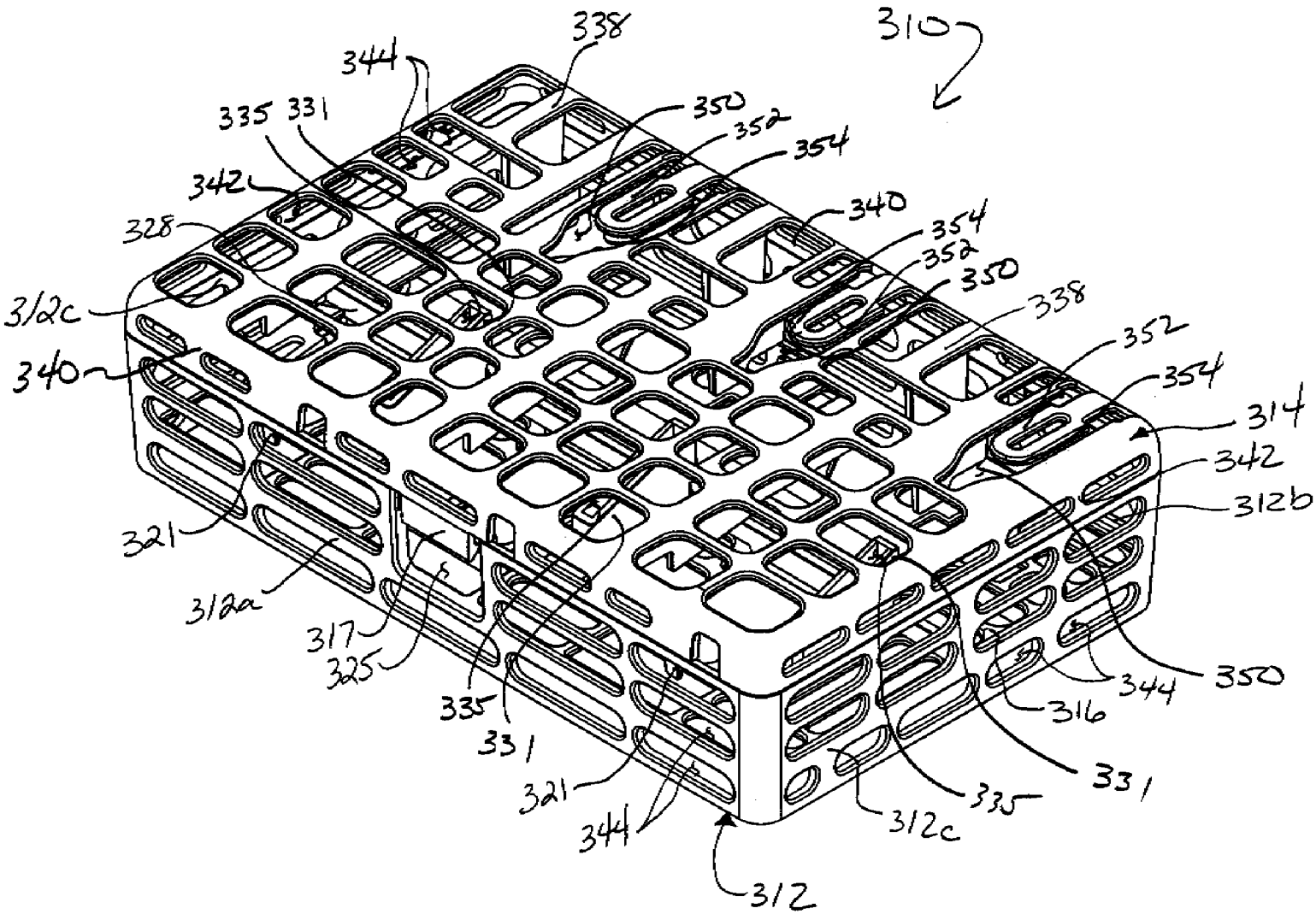
FIG. 39 is a perspective view of the apparatus of FIG. 35 with the various components of the nursing bottle assemblies omitted from the apparatus.
Figure 40:
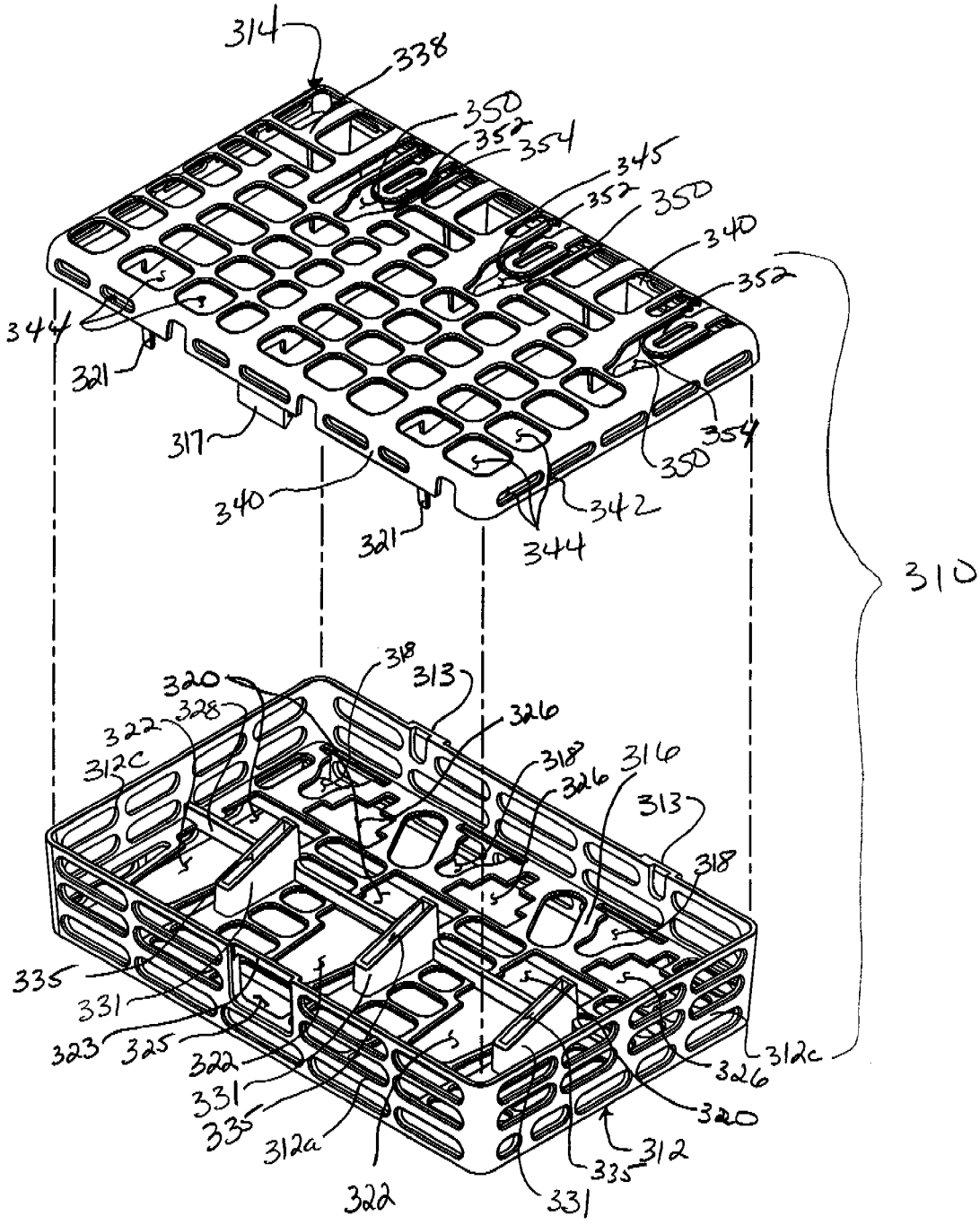
FIG. 40 is a perspective view of the apparatus of FIG. 35 with the retaining member exploded from the loading member.
Figure 41:
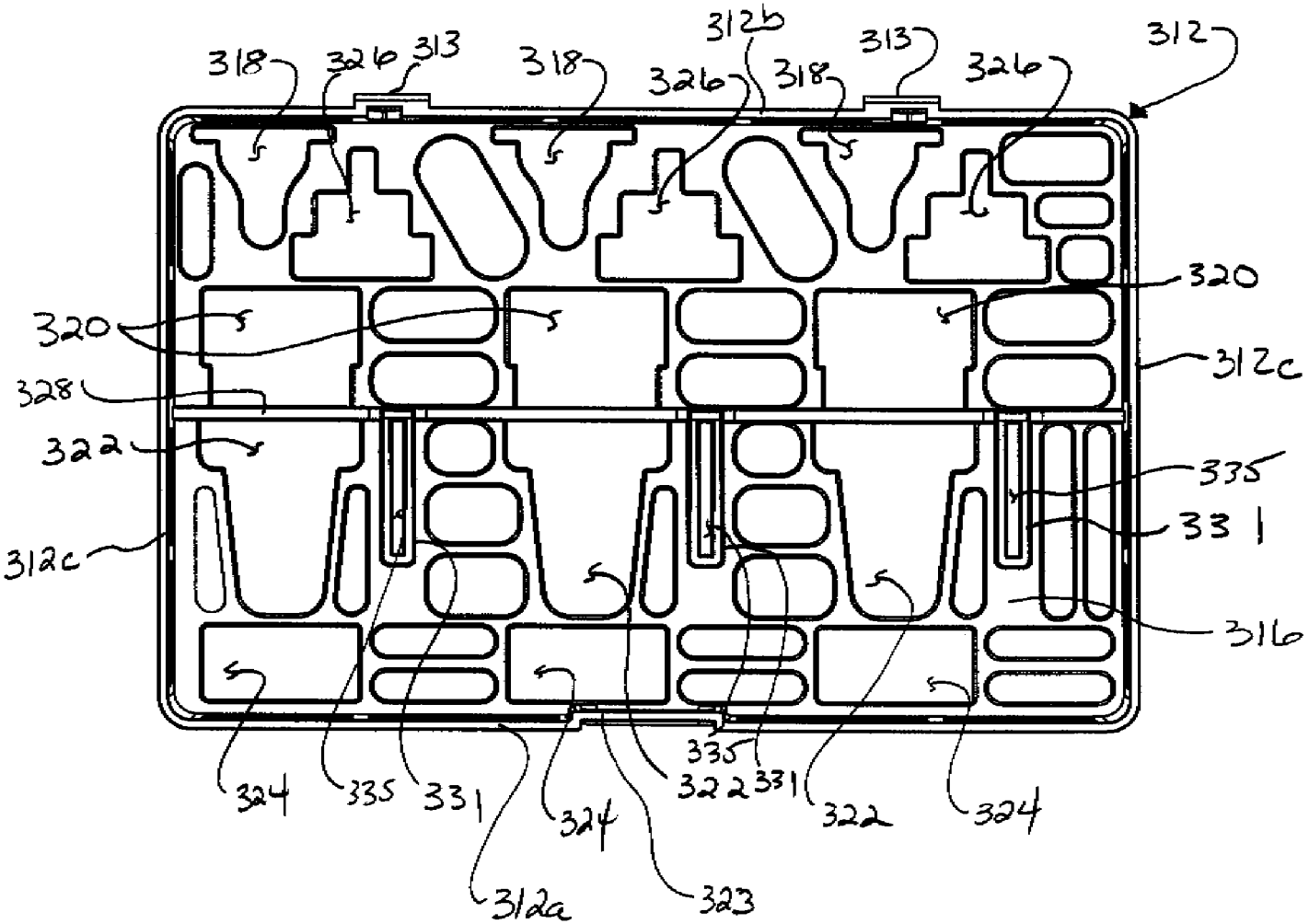
FIG. 41 is a top view of the loading member of the apparatus of FIG. 35.
Figure 42:
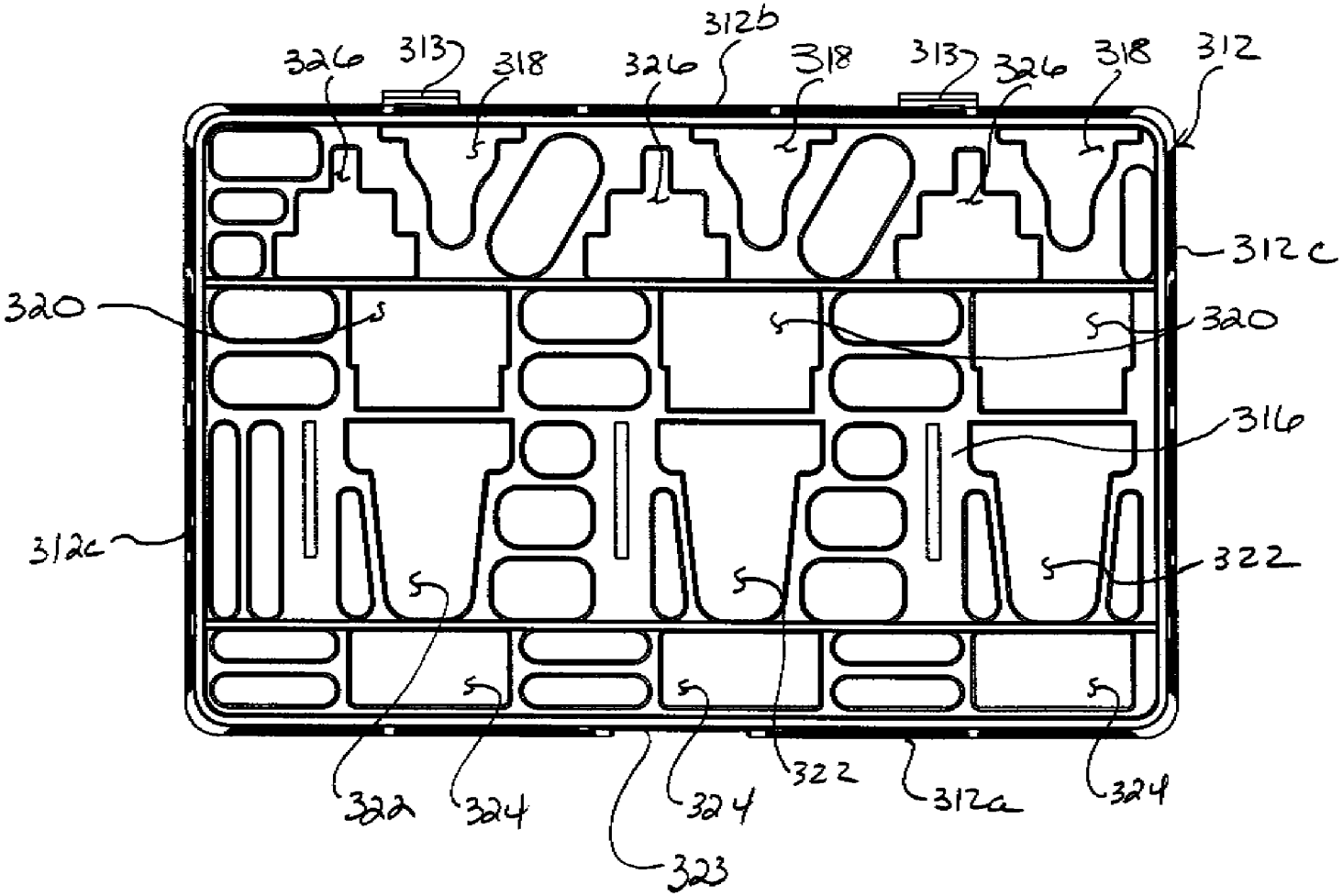
FIG. 42 is a bottom view thereof.
Figure 43:
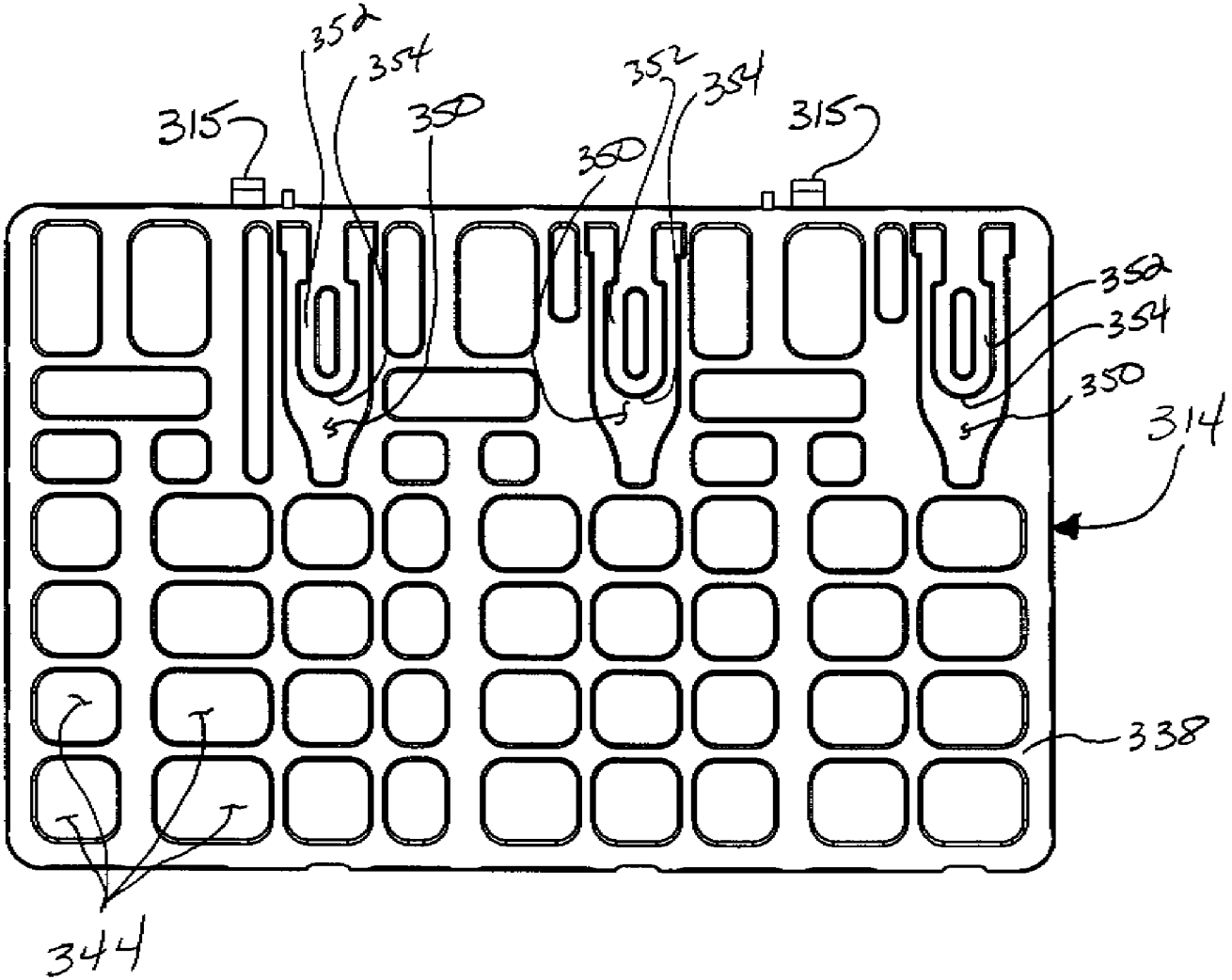
FIG. 43 is a top view of the retaining member of the apparatus.
Figure 44:
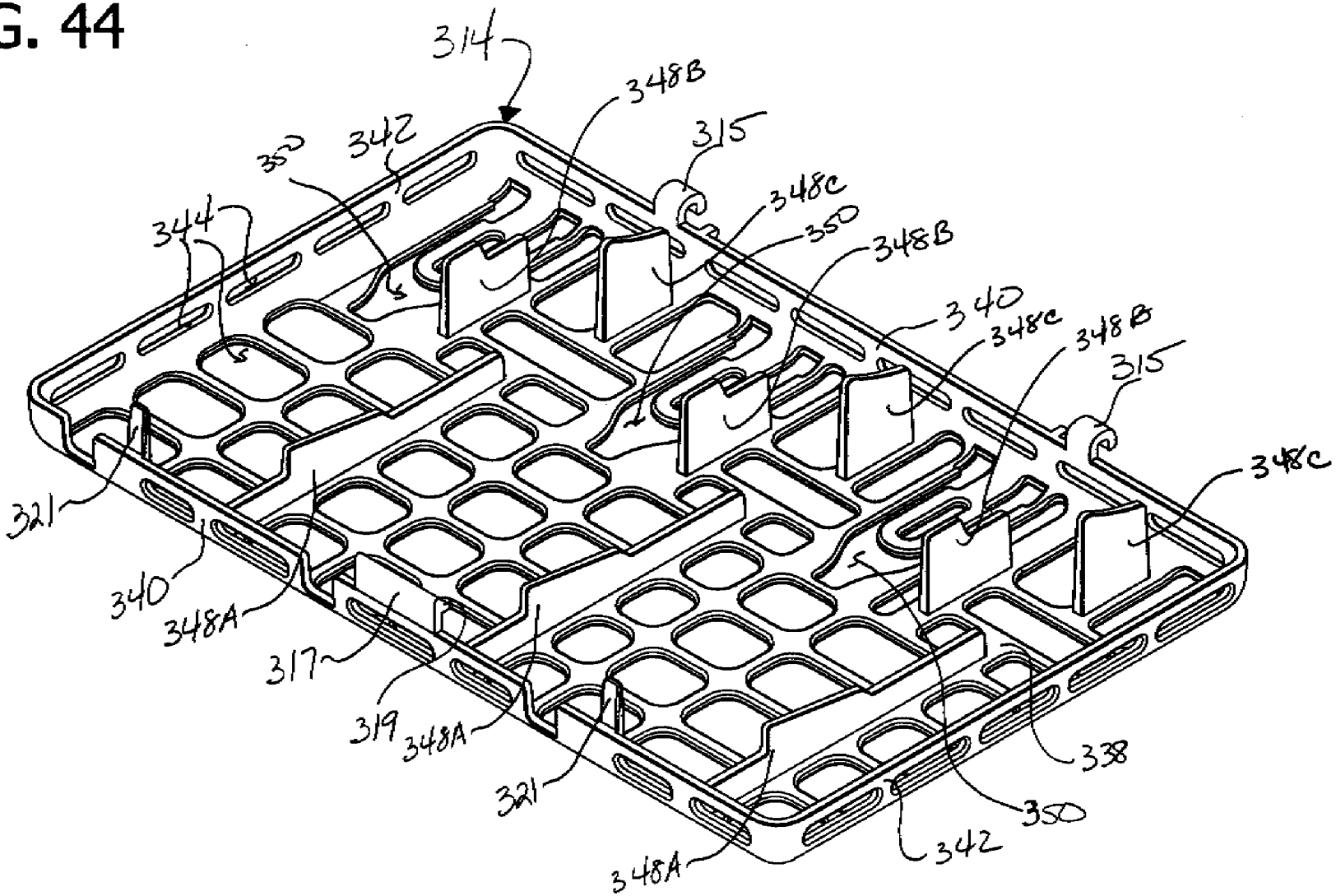
FIG. 44 is a bottom perspective view thereof.

With particular reference to FIGS. 26 and 34, attached to and extending from the top wall 238 of the retaining member are three sets of laterally extending ribs, such as ribs 248A attached to one of the side walls 240, ribs 248B spaced laterally from the one side wall, and ribs 248C attached to the opposite side wall of the retaining member 210. The ribs 248A, 248B, 248C are configured to extend down into closely spaced or even contacting relationship with the various bottle components 180 on the loading member 212 when the retaining member is assembled with the loading member to inhibit movement of the bottle components in the apparatus 210 during cleaning in the dishwasher.

Furthermore, attached to and extending from the top wall 238 of the retaining member 214 are two sets of longitudinally extending ribs, such as ribs 248D, spaced laterally from one of the side walls, and ribs 248E spaced laterally from the opposite side wall of the retaining member 214. Similar to ribs 248A, 248B, and 248C, ribs 248D are designed to retain a closure or travel cap 193 in place. Ribs 248E attach to and reinforce ribs 248A and 248B. As such, upon assembly of the retaining member 214 with the loading member 212, the apparatus 210 may be oriented in any manner within the dishwasher, such as with the loading member down, the retaining member down, or the apparatus oriented on one of its sides.

Figure 33:
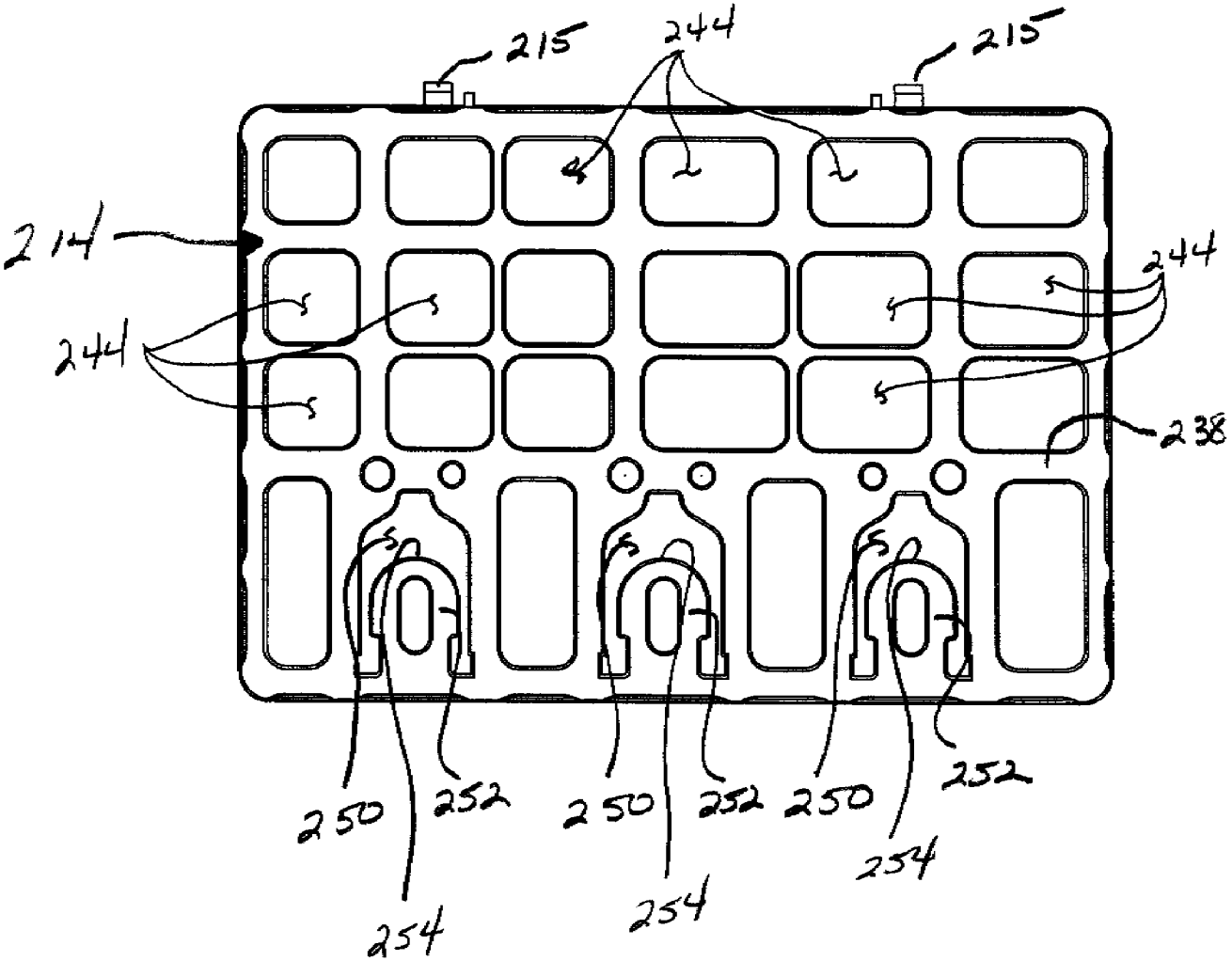
FIG. 33 is a top view of the retaining member of the apparatus of FIG. 25.

Referring now to FIG. 33, the top wall 238 of the retaining member 214 also includes three openings 250 sized and shaped for receiving the same component from each of the bottle assemblies 175. For example, in the illustrated embodiment the openings 250 are each sized and shaped for receiving a portion of the elongate tubes 183 from each of the bottle assemblies 175. A tab 252 extends laterally from the top wall 238 of the retaining member 214 into each of the openings 250 for mounting the elongate tubes 183 in the openings. Each of the tabs 252 includes a rounded edge 254 for allowing the elongate tube 183 to slide onto the tab.

The loading member 212 has two, spaced-apart pivot bars 213 extend from the rear wall 212*b* thereof (FIGS. 30-32), and the retaining member 214 has two hooks 215 (FIGS. 33 and 34) for snap-fit connection with the pivot bars of the loading member. The pivot bars 213 and hooks 215 cooperatively permit pivotal movement of the retaining member 214 with respect to the loading member 212. More specifically, the retaining member 214 can pivot with respect to the loading member 212 about the pivot bars 213 between a closed position (FIG. 25) wherein the components 180 of the bottle assembly 175 are securely supported within the apparatus 210, and an opened position (FIG. 26) where the components of the bottle assembly can be inserted into and/or removed from the loading member.

With reference again to FIGS. 26, 28, and 34, the retaining member 214 has a locking tab 217 having a flange 219, and two alignment tabs 221 for releasably securing the retaining member in the closed position of the retaining member. The locking tab 217 engages a locking bar 223 on the loading member 212. Furthermore, the loading member 212 has a release opening 225 for allowing a user to access the flange 219 of the locking tab 217 so that the retaining member 214 may be pivoted from the closed position to the open position. More specifically, in the closed position of the loading member 212, the flange 219 of the locking tab 217 has a snap-fit connection with the locking bar 223 to prevent the retaining member 214 from pivoting into the open position. In use, a user may reach through the release opening 225 and pull the locking tab 217 so that the flange 219 is positioned away from the locking bar 223, and thus, the retaining member 214 may be pivoted into the open position. Additionally, the alignment tabs 221 ensure that the retaining member 214 properly seats down over the loading member 212 in the closed position of the retaining member. In the closed position, the alignment tabs 221 engage the inner surface of the front wall 212*a* of the loading member 212 and limit movement of retaining member 214 with respect to the loading member in the closed position. It is contemplated that other fastening systems may be used to releasably secure the retaining member 214 and the loading member 212 in assembly with each other.

FIGS. 35-44 illustrate a fourth embodiment of the apparatus, generally indicated at 310, similar to the apparatus 210 of the third embodiment except that the apparatus is suitably configured to hold bottle components 80 (e.g., components 83, 85, 87, 89, 91, 93, 95, other than bottle 77) of a nursing bottle assembly 75 having another configuration such as that illustrated in FIGS. 11 and 12 and available from Handi-Craft Company of Saint Louis, Mo. under the tradename DR. BROWN'S NATURAL FLOW. As a result, the apparatus, including the loading member 312 and retaining member 314 are sized and shaped differently than the corresponding parts of the apparatus 210 to accommodate the different sized and shaped bottle components 80. Parts of the apparatus 310 shown in FIGS. 35-44 corresponding to parts of the apparatus 210 are identified using the same references number plus "100".

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. Apparatus for holding components of a nursing bottle assembly in a dishwasher, the nursing bottle assembly comprising a bottle, at least a first component adapted for assembly with the bottle and at least a second component different from the first component and adapted for assembly with the bottle, the apparatus comprising:

a loading member having a first opening sized and configured for receiving a portion of the first component therein to individually seat the first component on the loading member, and a second opening separate from the first opening and being sized and configured for receiving a portion of the second component therein to individually seat the second component on the loading member, the first and second openings differing in at least one characteristic indicative of the respective first and second components to facilitate identification of the first opening as being the proper location on the loading member for placement of the first component and of the second opening as being the proper location on the loading member for placement of the second component; and a retaining member connected to the loading member for pivoting movement between an open position to permit loading of the first and second components onto the loading member and a closed position for use of the apparatus in the dishwasher during operation thereof, the loading member and the retaining member being configured such that in the closed position the first and second components loaded onto the loading member are generally inhibited by at least one of the loading member and the retaining member against movement relative to the loading member and the retaining member, and against contact with all other components loaded into the apparatus, during operation of the dishwasher, said retaining member having at least one first rib depending therefrom for contacting at least one of the first and second components in the closed position of the retaining member, and at least one second rib depending therefrom and having at least one of a shape, size and orientation different from that of the first rib.

2. The apparatus set forth in claim 1 wherein the loading member and the retaining member each have a plurality of voids formed therein to permit water from the dishwasher to contact the first and second components during operation of the dishwasher.

3. The apparatus set forth in claim 1 wherein the at least one characteristic comprises the shape of the first and second openings, the first opening having a shape corresponding generally to a profile of the first component and the second opening having a shape corresponding generally to a profile of the second component.

4. The apparatus set forth in claim 3 wherein the first component of the nursing bottle assembly is a nipple and the second component of the nursing bottle assembly is a collar, the first opening having a shape corresponding generally to the profile of the nipple and the second opening having a shape corresponding generally to the profile of the collar.

5. The apparatus set forth in claim 1 wherein the apparatus is capable of holding the first and second components of a plurality of nursing bottle assemblies, the loading member of the apparatus comprising a plurality of the first openings and a plurality of the second openings.

6. The apparatus set forth in claim 1 wherein the loading member comprises a plurality of loading member walls that substantially surround the first and second openings of the loading member.

7. The apparatus set forth in claim 1 wherein the loading member comprises a pivot bar and the retaining member comprises a hook configured for a snap-fit connection with the pivot bar, the retaining member being pivotable with respect to the loading member about the pivot bar.

8. Apparatus for holding components of a nursing bottle assembly in a dishwasher, the nursing bottle assembly comprising a bottle, at least a first component adapted for assembly with the bottle and at least a second component different from the first component and adapted for assembly with the bottle, the apparatus comprising:

a loading member having a first opening sized and configured for receiving a portion of the first component therein to individually seat the first component on the loading member, and a second opening separate from the first opening and being sized and configured for receiving a portion of the second component therein to individually seat the second component on the loading member, the first and second openings differing in at least one characteristic indicative of the respective first and second components to facilitate identification of the first opening as being the proper location on the loading member for placement of the first component and of the second opening as being the proper location on the loading member for placement of the second component; and a retaining member connected to the loading member for pivoting movement between an open position to permit loading of the first and second components onto the loading member and a closed position for use of the apparatus in the dishwasher during operation thereof, the loading member and the retaining member being configured such that in the closed position the first and second components loaded onto the loading member are generally inhibited by at least one of the loading member and the retaining member against movement relative to the loading member and the retaining member, and against contact with all other components loaded into the apparatus, during operation of the dishwasher, said retaining member comprising a locking tab having a snap-fit connection with the loading member to prevent the retaining member from pivoting with respect to the loading member into the opened position.

9. The apparatus as set forth in claim 8 wherein the loading member has a release opening through which a user may grasp the locking tab to disconnect the locking tab from the loading member so that the retaining member may be pivoted into the open position.

10. The apparatus as set forth in claim 1 wherein the retaining member has at least one alignment tab to limit movement of the retaining member with respect to the loading member in the closed position.

* * * * *